US007011387B2

(12) United States Patent
Saito et al.

(10) Patent No.: US 7,011,387 B2
(45) Date of Patent: Mar. 14, 2006

(54) TUBE PUMP, DISCHARGE RECOVERING APPARATUS AND INK JET RECORDING APPARATUS

(75) Inventors: Hiroyuki Saito, Tokyo (JP); Yasuo Miyauchi, Tokyo (JP); Kenji Shigeno, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 161 days.

(21) Appl. No.: 10/633,530

(22) Filed: Aug. 5, 2003

(65) Prior Publication Data

US 2004/0027410 A1 Feb. 12, 2004

(30) Foreign Application Priority Data

Aug. 9, 2002 (JP) ..... 2002-232738

(51) Int. Cl.
*B41J 2/165* (2006.01)
*F04B 43/08* (2006.01)

(52) U.S. Cl. ..... 347/29; 347/30; 417/477.7

(58) Field of Classification Search ..... 347/22, 347/23, 29, 30, 33; 417/477.1, 477.7, 477.8, 417/477.11, 476

See application file for complete search history.

(56) References Cited

U.S. PATENT DOCUMENTS

| | | | | |
|---|---|---|---|---|
| 6,082,977 | A | 7/2000 | Nishioka | 417/476 |
| 6,612,682 | B1 * | 9/2003 | Saito | 347/30 |
| 6,629,749 | B1 | 10/2003 | Miyauchi et al. | 347/30 |
| 6,641,249 | B1 | 11/2003 | Miyauchi | 347/30 |
| 6,712,447 | B1 | 3/2004 | Saito | 347/30 |
| 6,722,757 | B1 | 4/2004 | Saito | 347/30 |

FOREIGN PATENT DOCUMENTS

| | | |
|---|---|---|
| CN | 1176179 | 3/1998 |
| JP | 2002/36603 | 2/2002 |

* cited by examiner

*Primary Examiner*—Shih-wen Hsieh
(74) *Attorney, Agent, or Firm*—Fitzpatrick, Cella, Harper, & Scinto

(57) ABSTRACT

An ink jet recording apparatus includes a tube pump for generating negative pressure in a tube, the tube pump being provided with a tube disposed along an arcuate guide portion, a pressing roller for squeezing the tube, a rotary member to which the pressing roller is rotatably journalled, and a supporting member to which the rotary member is rotatably journalled. The tube, the pressing roller, the rotary member and the rotary member supporting member are assembled to thereby form a pump unit, and are separable from the guide portion in the state of the pump unit. Thereby, the incorporation of the tube becomes easy, and the erroneous incorporation of the tube in its buckled state or its twisted state can be eliminated easily.

15 Claims, 15 Drawing Sheets

TUBE PUMP, DISCHARGE RECOVERING APPARATUS AND INK JET RECORDING APPARATUS

BACKGROUND OF THE INVENTION

1. Field of the Invention

This invention relates to a tube pump suitable as suction means of a discharge recovering apparatus carried on an ink jet recording apparatus for discharging ink from recording means to a recording material to thereby effect recording, a discharge recovering apparatus using the tube pump, and an ink jet recording apparatus provided with the discharge recovering apparatus.

2. Related Background Art

In recent years, the range of use of an ink jet recording apparatus has widened with a rise in its utilization value, and the types of ink jet recording apparatus have been increasing, such as an ink jet recording apparatus characterized by a high quality of photographic image, an ink jet recording apparatus used chiefly for black character recording, which uses a pigment ink for black alone to emphasize the distinctness of black and uses inks of other colors formed of dyes, and further an ink jet recording apparatus characterized by a low price. With the increase in the types of machine, the types of an ink jet recording head as the heart for discharging ink to thereby record an image have also increased, and individual discharge recovering apparatuses corresponding to respective heads have become required, and technical problems to be solved such as poor design efficiency and production efficiency, and a rise in cost resulting therefrom have also arisen.

FIG. 15 of the accompanying drawings is a typical perspective view showing an example of the discharge recovering apparatus of an ink jet recording apparatus according to the prior art, FIG. 16 of the accompanying drawings is a typical perspective view showing an example of the internal structure of the discharge recovering apparatus of FIG. 15, and FIG. 17 of the accompanying drawings is a typical perspective view showing another example of the internal structure of the discharge recovering apparatus of FIG. 15. In FIG. 15, when as the suction means 61 of the discharge recovering apparatus 6, use is made of a tube pump of a type in which a tube disposed along an arcuate guide portion (guide surface) is squeezed by a pressing roller journalled to a rotary member to thereby generate negative pressure (suction force), there is adopted a method of incorporating this tube along the arcuate guide surface by the cooperation thereof with the pressing roller, and this is advantageous for the downsizing of the apparatus and the curtailment of the number of parts, and therefore, a base member (recovering base) for mounting the various parts of the discharge recovering apparatus and the guide portion are constituted by a single part. That is, a construction is adopted in which the guide portion is formed on a portion of the base member of the discharge recovering apparatus.

Some of various ink jet recording heads to which the discharge recovering apparatus imparts the discharge recovering action have various functions as previously described. First, the ink jet recording head carried on the ink jet recording apparatus characterized by the high quality of photographic image is required to minimize the amount of ink discharged from a discharge port, and the opening diameter of the discharge port is a small diameter, and correspondingly thereto, discharge ports are arranged highly densely and the number of the discharge ports is great.

Therefore, when in the discharge recovering apparatus, in a capping state in which a cap is brought into close contact with a surface (discharge port surface) formed with a plurality of discharge ports, the interior of the cap is brought into a negative pressure state and ink is drawn out of each discharge port, it is necessary to make great negative pressure act, and a suction pump for generating the great negative pressure becomes necessary. For such a recording head, a tube pump 61 having two lines of tube 616 is connected to a cap 621, as shown in FIG. 16, to thereby make the negative pressure acting on the interior of the cap 621 great.

Also, in the ink jet recording apparatus for effecting chiefly black character recording, which uses a pigment ink for black alone to emphasize the distinctness of black and uses inks of other colors formed of dyes, when suction recovery is to be effected by the discharge recovering apparatus, it is necessary to suck the inks individually so that the pigment and the dyes may not mix with one another. Therefore, a plurality of caps is provided, or a closed space in one cap is divided into two. Such a recording head is handled by using a tube pump 61 having two lines of tubes 616 similar to those in FIG. 16, and divisionally connecting respective ones of the two lines of tubes to two caps 621*a* and 621*b* as shown in FIG. 17. By such a contrivance the discharge recovering apparatus corresponding to the aforedescribed two types of recording heads can be made with only the difference in parts between FIG. 16 and FIG. 17, and the mitigation of the poor design efficiency and production efficiency and a rise in cost resulting therefrom is achieved.

However, the aforedescribed ink jet recording apparatus, and the discharge recovering apparatus and the tube pump (pump unit) which are the constituents thereof, have suffered from such technical problems to be solved, as will be described below. That is, in the incorporating of the tubes in the tube pump, there is adopted a method of incorporating the tubes along an arcuate guide surface for crushing the tubes by the cooperation with the pressure roller. However, when the tubes are shifted in an attempt to adjust the mounted positions of the tubes when bringing the tubes along the inner side of the arcuate portion, there occurs the action of the tubes restoring to their straight state, and the tubes have stuck on the guide surface or have floated up from the guide surface and the state of the tubes has not been stable, and the assembling of the tubes has been very difficult. This has resulted in the technical problem that the tubes are liable to be incorporated in a positionally deviated state, a slack state, a buckled state or a twisted state, and erroneous incorporation is liable to occur.

Also, when during the operation of the tube pump, the tubes are pulled by the squeezing action of the pressing roller, it is necessary to fix the mounted position so as not to deviate or come off. Many constituent parts including the tube pump are incorporated in the base member of the discharge recovering apparatus on which the aforementioned guide surface is formed so as to functionally operate, and therefore, a tube fixing portion cannot be disposed in a free space, and it has been difficult to avoid the great deformation of the tubes. If the deformed portions of these tubes exist near the guide surface, when a pump pressure roller rushes into a state opposed to the guide surface, a load suddenly rises, the state opposed to the guide surface is released, there occurs the phenomenon that the pressing roller is pushed out by the elastic force of restitution of the tubes, and the aforementioned rotary member is rotated more rapidly than a driving speed, and this has led to the technical problem that a faulty operation is caused.

Also, the base member on which the various parts of the discharge recovering apparatus are mounted and the aforementioned guide surface are constituted by a single part so as to be advantageous for the downsizing of the apparatus and the curtailment of the number of parts, but since high rigidity and high dimensional accuracy are required of the base member of the discharge recovering apparatus, it is necessary to make the base member by the use of a glass-containing material. Also, in the discharge recovering apparatus of the ink jet recording apparatus according to the prior art, use is made of a construction in which the rotary member is directly rotatably supported by the base member, but the glass-containing material lacks slidability and therefore, when the rotary member is rotated under the great reaction force of the pressure force of the tubes, there arise inconveniences that a great load is produced, the shaving of the material occurs and the shaved powder comes into a sliding portion to thereby cause abnormal sound, and this has led to the technical problem that the application of grease becomes necessary as a countermeasure. In the discharge recovering apparatus, it is required to decrease the application of grease as much as possible from the viewpoint that if the grease adheres to the cap or a wiper, it may close the discharge ports of the recording head.

Also, in recent years, the use of the ink jet recording apparatus has become wider, whereby depending on the use thereof, the types (the diameter and number of the discharge ports) of the recording head with which the discharge recovering apparatus of the ink jet recording apparatus must cope, the kinds of the ink used (dyes, a pigment or a-mixture thereof), and the kinds (construction and number) of ink tanks connected have also continued to increase. If the performance difference required of the suction pump of the discharge recovering apparatus becomes great due to the differences in these types and kinds, it becomes difficult to cope with it by only such tube connecting method as in the aforedescribed example of the prior art, and it becomes necessary to change even the diameter of the tubes of the tube pump and thus, a greatly different discharge recovering apparatus must be newly made.

SUMMARY OF THE INVENTION

It is an object of the present invention to provide a tube pump which is made separable in the state of a pump unit to thereby facilitate the incorporation of a tube, and easily eliminate the erroneous incorporation of the tube in a buckled state or a twisted state, a discharge recovering apparatus using the tube pump, and an ink jet recording apparatus provided with the discharge recovering apparatus.

It is another object of the present invention to provide a tube pump which can commonly use all or almost all of parts except a tube to precisely cope with a variety of ink jet recording means, and can achieve an improvement in design efficiency and production efficiency and the curtailment of cost, a discharge recovering apparatus using the tube pump, and an ink jet recording apparatus provided with the discharge recovering apparatus.

It is another object of the present invention to provide a tube pump in which the direct sliding movement of a guide member and a rotary member can be avoided without a bearing being added, and an increase in the load of the sliding region of a rotary member supporting member, the occurrence of abrasion and the production of abnormal sound can be prevented without an increase in the cost of the parts, and which can eliminate the necessity of applying grease, a discharge recovering apparatus using the tube pump, and an ink jet recording apparatus provided with the discharge recovering apparatus.

It is another object of the present invention to provide a tube pump in which the creeping of a tube can be completed in a pump portion to thereby improve the incorporability of the tube pump, and a rotary member supporting member and fixing means for the tube or a joint portion can be formed by a single part to thereby eliminate an extra joint part and the step of assembling it, a discharge recovering apparatus using the tube pump, and an ink jet recording apparatus provided with the discharge recovering apparatus.

It is another object of the present invention to provide a tube pump which can prevent the occurrence of the earlier rotation phenomenon of a pressure roller relative to a rotary member (driving means) (the phenomenon of the pressure roller being rotated earlier in a direction of rotation than the rotation of the rotary member) caused by an elastic restitutional repulsive force or the like during the opening of tube during a pump operation, a discharge recovering apparatus using the tube pump, and an ink jet recording apparatus provided with the discharge recovering apparatus.

The present invention is a tube pump for generating negative pressure in a tube, provided with the tube disposed along an arcuate guide portion, a pressing roller for squeezing the tube, a rotary member to which the pressing roller is rotatably journalled, and a supporting member to which the rotary member is rotatably journalled, characterized in that the tube, the pressing roller, the rotary member and the rotary member supporting member are assembled to thereby form a pump unit, and are made separable from the guide portion in the state of the pump unit.

The present invention adopts, in a tube pump for generating negative pressure in a tube, a construction which is provided with a tube disposed along an arcuate guide portion, a pressing roller for squeezing the tube, a rotary member to which the pressing roller is rotatably journalled, and a supporting member to which the rotary member is rotatably journalled, and in which the tube, the pressing roller, the rotary member and the rotary member supporting member are assembled to thereby form a pump unit, and are made separable from the guide portion in the state of the pump unit, and therefore there is provided a tube pump in which the incorporation of the tube is easy and the erroneous incorporation of the tube in its buckled state or its twisted state can be eliminated easily.

DESCRIPTION OF THE PREFERRED EMBODIMENTS

Figure 1:
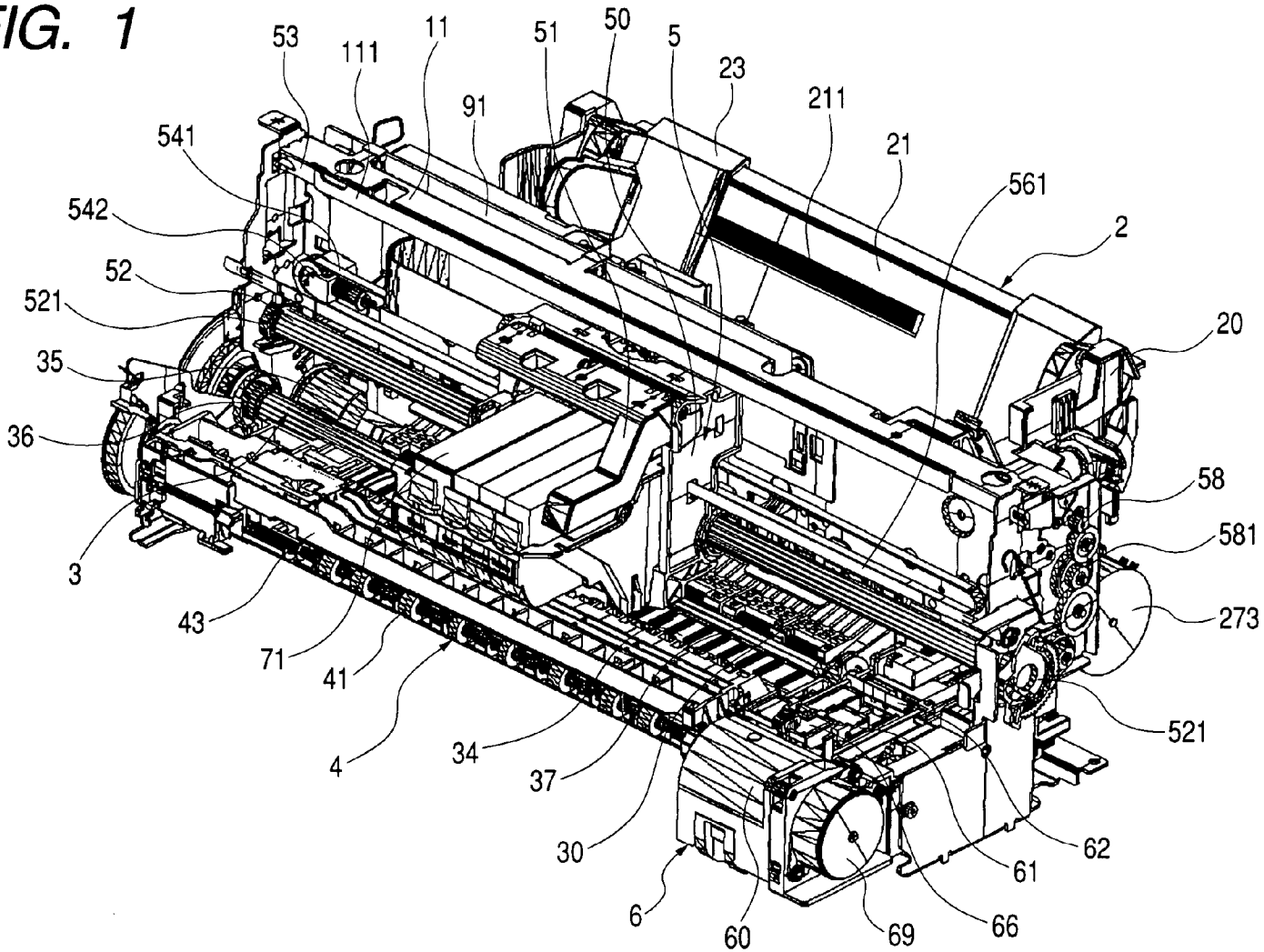
FIG. 1 is a typical perspective view of the internal mechanism of an embodiment of an ink jet recording apparatus provided with a discharge recovering apparatus to which the present invention is applied as it is seen from the right front thereof.
Figure 2:
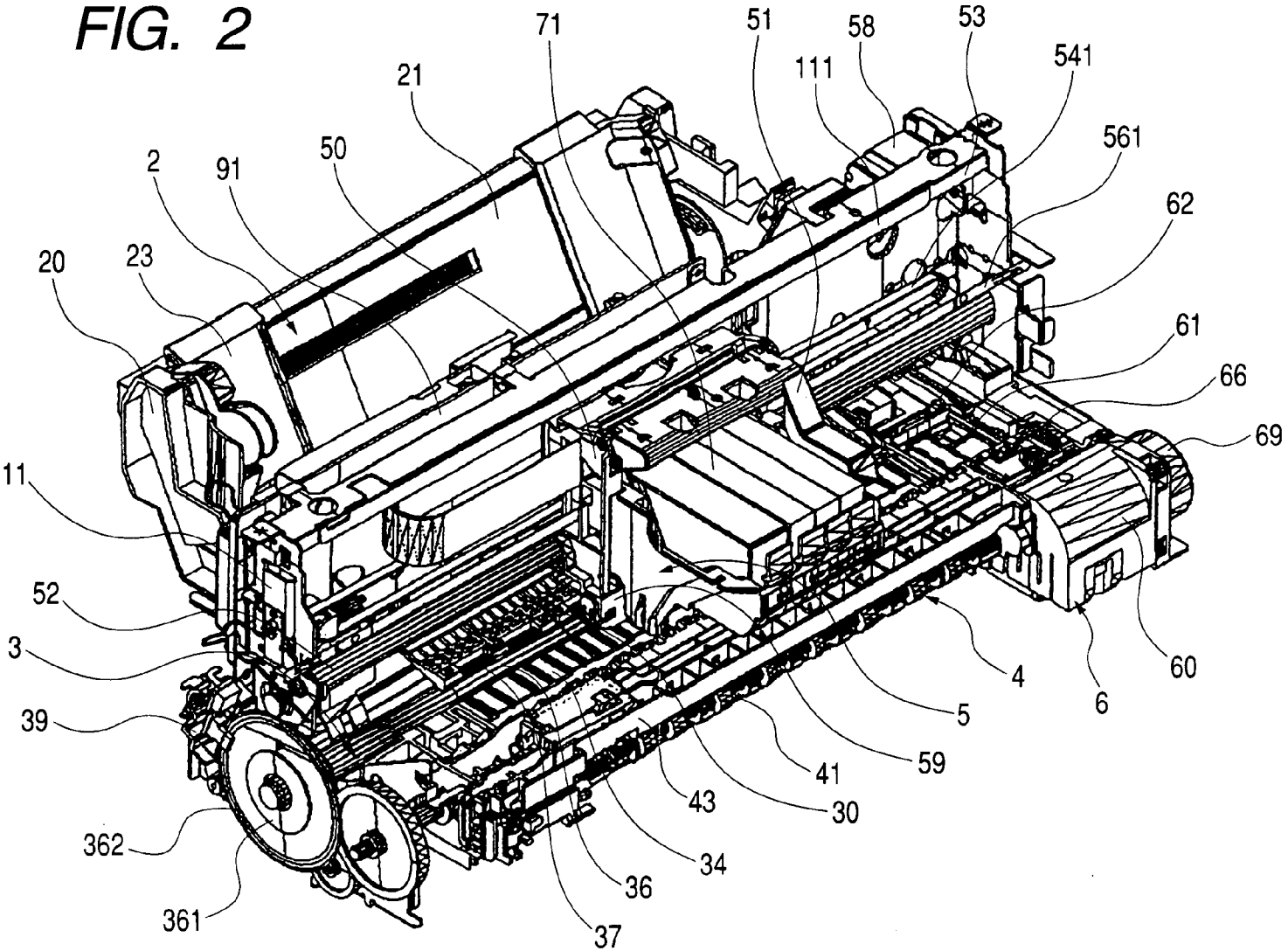
FIG. 2 is a typical perspective view of the internal mechanism of the ink jet recording apparatus of FIG. 1 as it is seen from the left front thereof.
Figure 3:
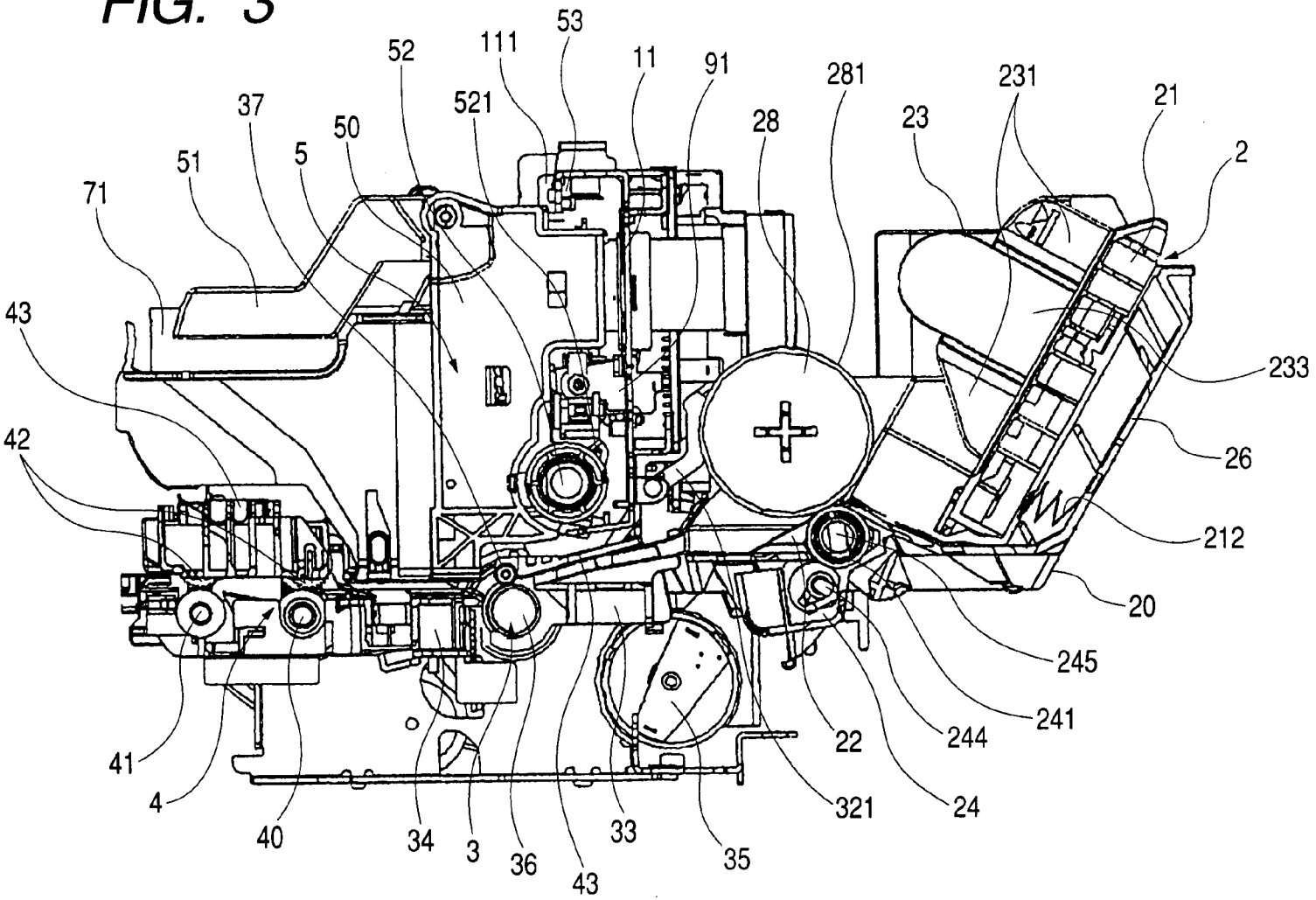
FIG. 3 is a typical vertical cross-sectional view of the ink jet recording apparatus of FIG. 1.

Some embodiments of the present invention will hereinafter be specifically described with reference to the drawings. Throughout the drawings, like reference characters designate like or corresponding portions. FIG. 1 is a perspective view of the internal mechanism of an embodiment of an ink jet recording apparatus to which the present invention is applied as it is seen from the right front thereof, and FIG. 2 is a perspective view of the internal mechanism of the ink jet recording apparatus of FIG. 1 as it is seen from the left front thereof. FIG. 3 is a vertical cross-sectional view of the ink jet recording apparatus of FIG. 1. FIGS. 4 to 15 are drawings for illustrating the construction and operation of an embodiment of a discharge recovering apparatus mounted in an ink jet recording apparatus to which the present invention is applied. In FIGS. 1 to 3, the ink jet recording apparatus 1 according to the present embodiment is provided with a sheet feeding portion 2, a sheet conveying portion 3, a sheet discharging portion 4, a carriage portion (recording means moving means) 5, a discharge recovering apparatus (a discharge recovering portion and a cleaning portion) 6, recording means (a recording head) 7 and an electrical portion 9. These various portions will hereinafter be schematically successively described.

(A) Sheet Feeding Portion

The sheet feeding portion 2 is comprised of a pressure plate 21 for stacking sheet materials P thereon, a sheet feeding roller 28 for feeding the sheet materials P, a separating roller 241 for separating the sheet materials P, a returning lever 22 for returning the sheet materials P to a stacking position, etc., mounted on a base 20 (FIG. 3). The sheet feeding roller 28 is of a bar shape having an arcuate cross-section, and this sheet feeding roller 28 is provided with separating roller rubber (sheet feeding roller rubber) 281 toward the sheet. The feeding of the sheet material is effected by such a sheet feeding roller 28. The driving of the sheet feeding roller 28 is effected by a driving force transmitted from a sheet feeding motor 273 for exclusive use provided in the sheet feeding portion 2 through a drive transmitting gear. A movable side guide 23 is provided on the pressure plate 21 movably in the widthwise direction of the recording material, and regulates the stacking position of the sheet materials P. The pressure plate 21 is rotatable about a rotary shaft coupled to the base 20, and is biased toward the sheet feeding roller 28 by a pressure plate spring 212. The pressure plate 21 is designed to be capable of being brought into contact with and spaced apart from the sheet feeding roller 28 by a pressure plate cam (not shown).

Further, a separating roller holder 24 having mounted thereon the separating roller 241 for separating the sheet materials P one by one is mounted on the base 20. This separating roller holder 24 is pivotally movable about a rotary shaft provided on the base 20 and is mounted while being biased toward the sheet feeding roller 28 by a separating roller spring 242. A separating roller clutch (clutch spring) (not shown) is mounted on the separating roller 241, and design is made such that when a predetermined or greater load is applied to the separating roller 241, a portion on which the separating roller 241 is mounted can rotate. The separating roller 241 is designed to be capable of being brought into contact with and spaced apart from the sheet feeding roller 28 by a separating roller release shaft 244 and a control cam (not shown). The positions of the pressure plate 21, the returning lever 22 and the separating roller 241 are detected by an auto sheet feeder (ASF) sensor (not shown). Also, the returning lever 22 for returning the sheet material P to the stacking position is pivotally mounted on the base 20, and is biased in a releasing direction by a returning lever spring (not shown). This returning lever 22 is designed to be rotated by the aforementioned control cam (not shown) when it returns the sheet material P to the stacked position.

Description will hereinafter be made of a state in which sheet feeding is effected by the use of the above-described construction. In an ordinary standby state, the pressure plate 21 is released by a pressure plate cam (not shown), and the separating roller 241 is released by the control cam (not shown). Further, the returning lever 22 returns the sheet material P to the stacking position and is in the state of the stacking position in which it closes a stacking post so that the sheet materials P may not enter the inner part during stacking. When sheet feeding is started from this state, the separating roller 241 is first brought into contact with the sheet feeding roller 28 by the driving of a motor. The returning lever 22 is then released and pressure plate 21 comes into contact with the sheet feeding roller 28. In this state, the feeding of the sheet materials P is started. The sheet material P is limited by an auto-stage separating portion (not shown) provided on the base 20 and only a predetermined number of sheet materials P are fed to a nip portion formed by the sheet feeding roller 28 and the separating roller 241. The fed sheet materials P are separated by this nip portion and only the uppermost sheet material P is conveyed (fed).

When the sheet material P arrives at a pair of conveying rollers comprising a conveying roller 36 and a pinch roller 37 which will be described later, the pressure plate 21 and the separating roller 28 are released by the pressure plate cam (not shown) and the control cam (not shown), respectively. Also, the returning lever 22 is returned to the stacking position by the control cam (not shown). At this time, the returning lever can return the sheet material P having arrived at the nip portion between the sheet feeding roller 28 and the separating roller 241 to the stacking position.

(B) Sheet Conveying Portion

The sheet conveying portion 3 has a conveying roller 36 for conveying the sheet materials P and a PE sensor 32. The conveying roller 36 is of a construction in which the surface of a metal shaft is coated with fine particles of ceramics, and is mounted on a chassis 11 by the metallic portions of the shaft portions at the opposite ends thereof being received by bearings 38. A plurality of driven pinch rollers 37 are in contact with the conveying roller 36. The pinch rollers 37 are held by a pinch roller holder 30 and are brought into pressure contact with the conveying roller 36 by a pinch roller spring (not shown) to thereby give birth to a conveying force for the sheet materials P. The pinch roller holder 30 is provided with a PE sensor lever 321 for transmitting the detection of the leading edge and trailing edge of the sheet material P to a PE sensor (not shown). A platen 34 is mounted and positioned on the chassis 11. Further, a recording head 7 as recording means for forming an image on the basis of image information is reciprocally movably mounted downstream of the conveying roller 36 with respect to a sheet material conveying direction.

In the above-described construction, the sheet material P fed to the sheet conveying portion 3 is guided to the pinch roller holder 30, and is conveyed to the pair of rollers comprising the conveying roller 36 and the pinch roller 37. At this time, the leading edge of the conveyed sheet material P is detected by the PE sensor lever 321 to thereby determine a recording position (a printing position or an image forming position) for the sheet material P. Also, the sheet material P is conveyed on the platen 34 by the pair of rollers 36 and 37 being rotated by a conveying motor 35. The driving of the conveying roller 36 is effected by the rotational force of the conveying motor 35 comprising a DC motor being transmitted to a pulley 361 provided on the shaft of the conveying roller 36 by a timing belt (not shown).

Also, a code wheel 362 for detecting the amount of conveyance by the conveying roller 36 is provided on the shaft of the conveying roller 36. This code wheel 362 is formed with markings at a pitch of 150 lpi to 300 lpi. An encoder sensor 363 for reading the markings is mounted on a region of the chassis 11 which is adjacent to the code wheel 362. An ink jet recording head is used as the recording means (recording head) 7. A discrete ink tank 71 is interchangeably mounted on this recording head 7 for each ink color. Also, this recording head 7 can give discharging heat energy to the ink by a heater (heat generating element) or the like driven on the basis of recording data. The ink is film-boiled by this heat (discharging energy), and design is made such that by a pressure change caused by the growth or contraction of a bubble by this film boiling, the ink is discharged from the discharge port of the recording head 7, and an image is formed on the sheet material P by the discharged ink drop.

(C) Carriage Portion

The carriage portion 5 has a carriage 50 for moving the recording head 7 as the recording means in a direction (main scanning direction) intersecting with the recording material conveying direction. This carriage 50 is guided and supported for reciprocal movement in the main scanning direction by a guide shaft 52 and a guide rail 111 installed in a direction orthogonal to the conveying direction of the sheet material P. The guide rail 111 also has the function of holding the rear end of the carriage 50 to thereby maintain the gap (between sheets) between the recording head 7 and the sheet material P at a proper value. The guide shaft 52 is mounted on the chassis 11, and the guide rail 111 is formed integrally with the chassis 11. A thin sliding sheet 53 of SUS or the like is stretched on the sliding side of the guide rail 111 with respect to the carriage 50, whereby a reduction in sliding sound is achieved.

Also, the carriage portion 5 (carriage 50) is driven by a carriage motor (not shown) mounted on the chassis 11 through a timing belt 541. This timing belt 541 is stretched and supported by an idle pulley 542. The timing belt 541 and the carriage 50 are coupled together through a damper (not shown) formed of rubber or the like, and the vibration of the carriage motor (not shown), etc. is attenuated to thereby reduce image unevenness or the like. In order to detect the position of the carriage 50, a code strip 561 formed with markings at a pitch of 150 lpi to 300 lpi is provided in parallelism to the timing belt 541. Further, an encoder sensor (not shown) for reading the code strip 561 is provided on a carriage substrate (not shown) carried on the carriage 50. This carriage substrate (not shown) is also provided with a contact (not shown) for effecting electrical connection to the recording head 7. Also, the carriage 50 is provided with a flexible substrate 57 for transmitting a head signal from an electrical portion (electrical substrate) 9 to the recording head 7.

In order to fix the recording head 7 as the recording means to the carriage 50, a dash portion (not shown) for positioning and pressing means (not shown) for pressing the recording head 7 to thereby fix it, are provided on the carriage 50. This pressing means (not shown) is provided on a head set lever 51, and is designed such that a pressing force acts on the recording head 7 when the head set lever 51 is pivotally moved about a fulcrum to thereby set recording head 7. Also, eccentric cams 521 are provided on the opposite ends of the guide shaft 52, and by the driving of a carriage lifting motor 58, the drive is transmitted to the eccentric cams 521 through a gear train 581, whereby the guide shaft 52 can be moved up and down. In conformity with this upward and downward movement of the guide shaft 52, the carriage 50 is likewise moved up and down, whereby an optimum gap can be formed even for a sheet material P differing in thickness.

In the above-described construction, when an image is to be formed on the sheet material P, the sheet material P is conveyed to the position of a line to be recorded (a position in the conveying direction of the sheet material P) by the pair of rollers (conveying roller and pinch roller) 36 and 37 and also, the carriage 50 is moved to a recording (image forming) start position by the carriage motor 54 to thereby oppose the recording head 7 to a recording position (image forming position). Thereafter, in operative association with the main scanning movement of the carriage 50, the recording head 7 discharges the ink toward the sheet material P by a signal from the electrical portion (electrical substrate) 9, whereby recording (image forming) is effected.

(D) Sheet Discharging Portion

The sheet discharging portion 4 is provided with two sheet discharging rollers 40, 41, spurs 42 abutting against the sheet discharging rollers 40, 41 under a given pressure to be thereby rotatable, and a gear train for transmitting the driving of the conveying roller 36 to the sheet discharging rollers 40, 41 (FIG. 3). The sheet discharging rollers 40 and 41 are mounted on the platen 34. The sheet discharging roller 40 upstream with respect to the conveying direction is comprised of a metal shaft and a plurality of rubber portions (sheet discharging roller rubber) 401 provided thereon. The sheet discharging roller 40 is driven by the drive from the conveying roller 36 being transmitted thereto through an idler gear. The sheet discharging roller 41 is of a construction in which a plurality of elastic members 411 of elastomer or the like are mounted on a shaft of resin. The sheet discharging roller 41 is driven by the drive being transmitted thereto from the sheet discharging roller 40 through an idler gear.

As the spur 42, use is made, for example, of a thin plate of SUS provided with a plurality of convex shapes around it and molded integrally with a resin portion. Such a spur 42 is mounted on a spur holder 43. In the present embodiment, the mounting of the spurs 42 onto the spur holder 43 and the pressure contact of the spurs 42 with the sheet discharging rollers 40, 41 are effected by a spur spring (not shown) comprising a coil spring provided in the shape of a bar. There are two kinds of spurs, i.e., a spur for chiefly giving birth to a conveying force for the sheet material P, and a spur for chiefly hampering the floating-up of the sheet material P during recording. The spur for chiefly giving birth to the conveying force is disposed at a position corresponding to the rubber portions (sheet discharging roller rubber portions, elastic member portions) 401 of the sheet discharging rollers 40, 41. On the other hand, the spur for chiefly hampering the floating-up of the sheet material P is disposed at a position (as between adjacent ones of the rubber portions 401) whereat the rubber portions 401 of the sheet discharging rollers 40, 41 are absent. By the above-described construction, the sheet material P on which recording (image forming) has been effected by the carriage portion 5 is nipped and discharged by the nip portion between the sheet discharging roller 41 and the spur 42.

(E) Discharge Recovering Apparatus (Discharge Recovering Portion, Cleaning Portion)

In the ink jet recording apparatus 1, the discharge recovering apparatus 6 for recovering the discharge from the recording head 7 is disposed at a desired position (e.g. a position corresponding to the home position) outside the range of reciprocal movement (outside the recording area) for the recording operation of the carriage 50 carrying the recording head 7 thereon. Such a discharge recovering apparatus (discharge recovering portion, cleaning portion) 6 is generally provided with suction means 61 as a negative pressure generating source, capping means 62 for capping the discharge port surface of the recording head 7, and wiping means 63 for cleaning the discharge port surface of the recording head 7. In operative association with the capping of the discharge port surface by the capping means 62, the ink is forcibly discharged from the discharge port by the suction means 61 in the discharge recovering apparatus 6, whereby it is possible to carry out the discharge recovering process of removing any viscosity-increased ink, bubbles, etc. in the ink flow path of the recording head 7.

Also by capping the discharge port surface of the recording head 7 during non-recording or the like, it is possible to protect the recording head 7, and also prevent the desiccation of the ink. The suction means 61 is connected to the capping means 62. Also, the wiping means 63 is disposed near the capping means 62 and is adapted to wipe off ink drops adhering to the discharge port surface of the recording head 7. By the suction means 61, the capping means 62 and the wiping means 63, it is possible to keep the recording head 7 in a normal state (a state in which there is not the clogging or the like of the discharge port and a normal recording operation is possible).

Figure 4:
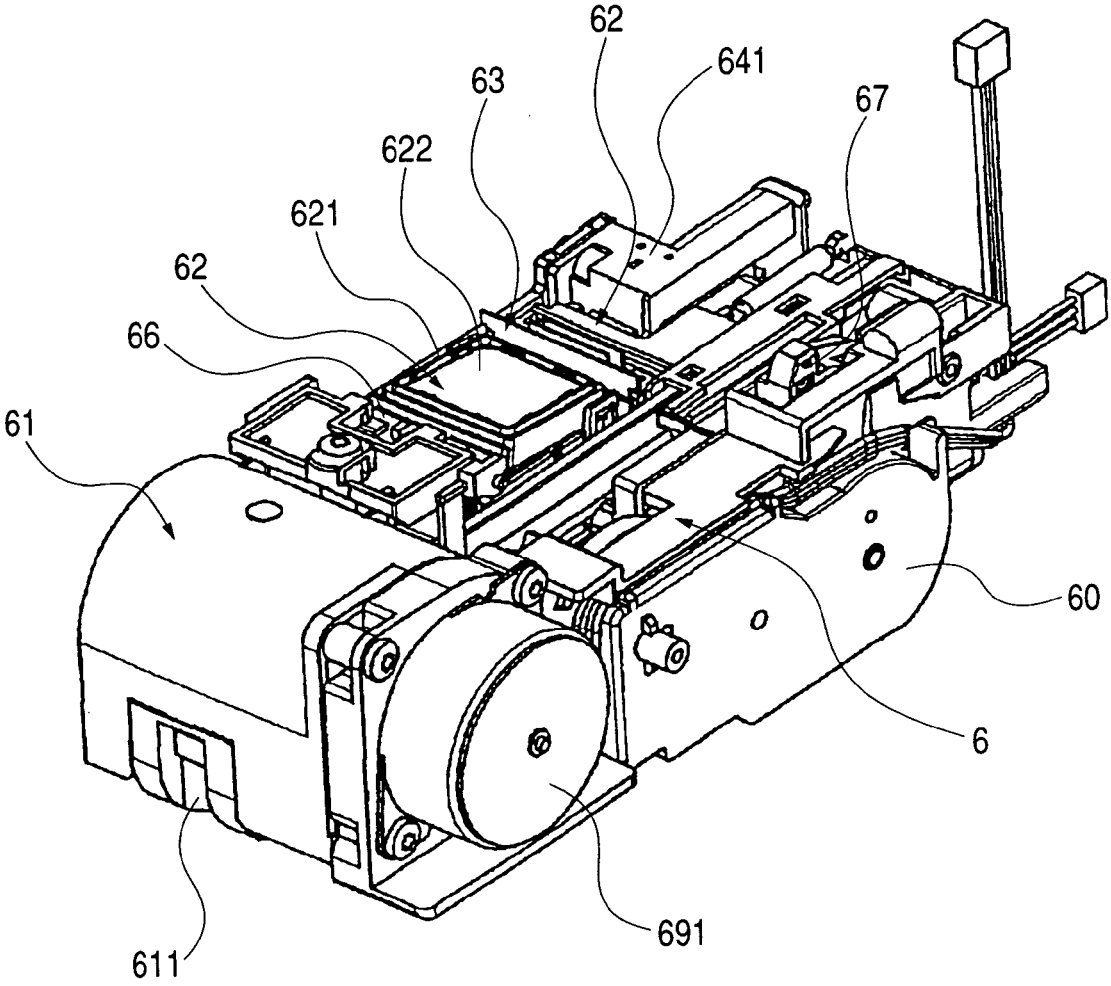
FIG. 4 is a typical perspective view of an embodiment of the discharge recovering apparatus of an ink jet recording apparatus to which the present invention is applied as it is seen from the right front thereof.
Figure 5:
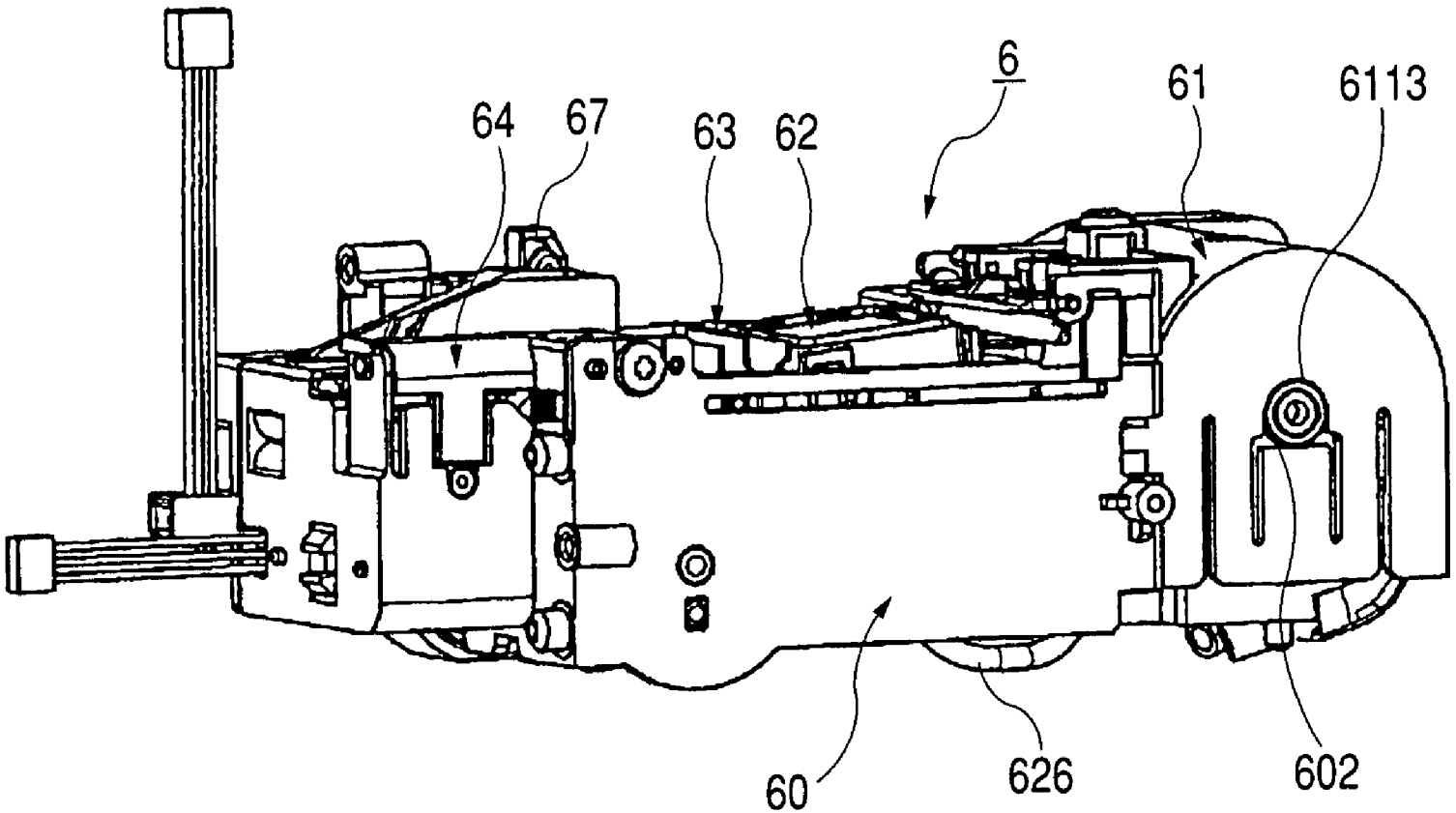
FIG. 5 is a typical perspective view of the discharge recovering apparatus of FIG. 4 as it is seen from the left side thereof.
Figure 6:
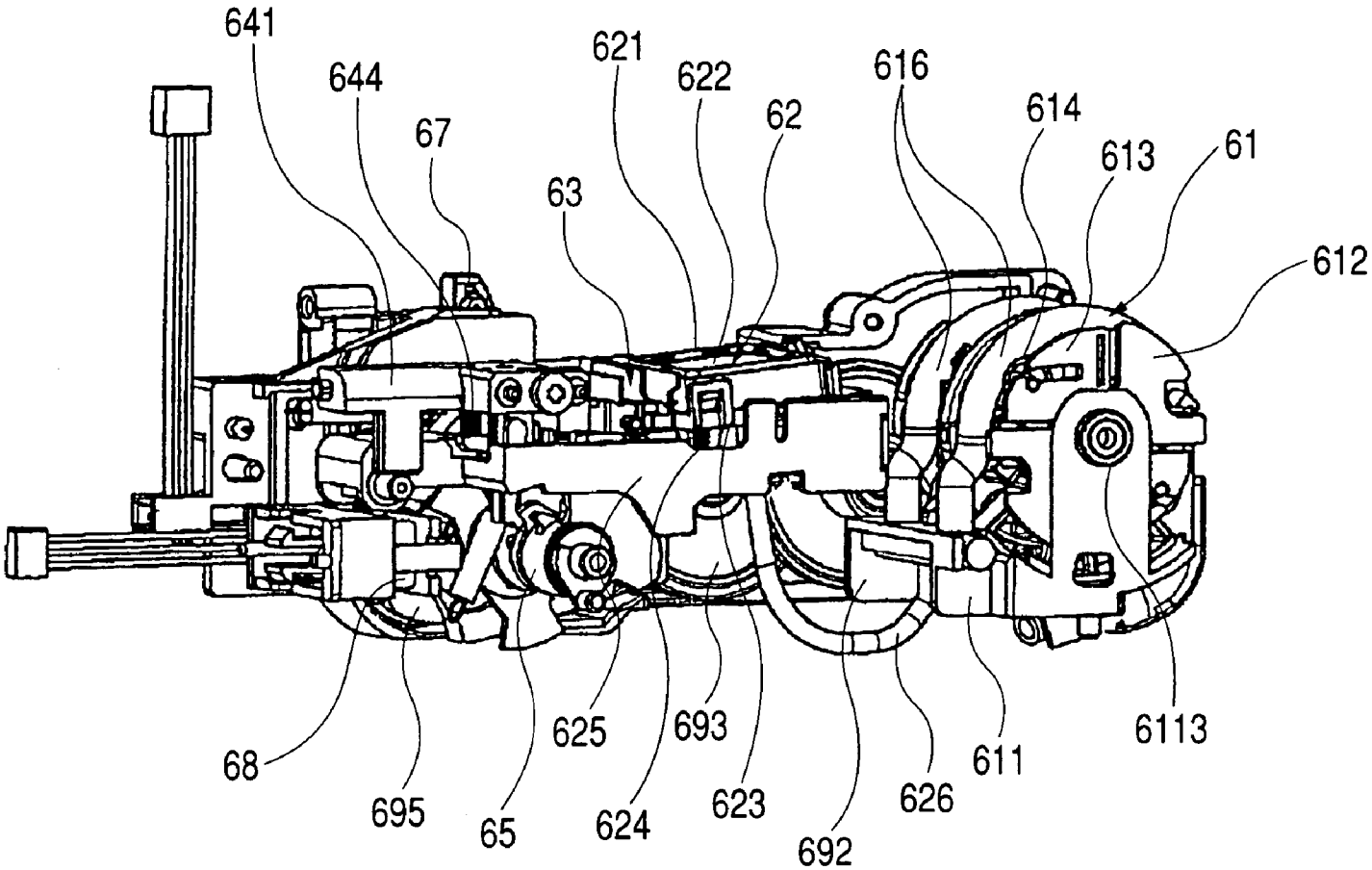
FIG. 6 is a typical perspective view showing the internal structure with a recovering base as an outer frame portion removed in the discharge recovering apparatus of FIG. 5.
Figure 7:
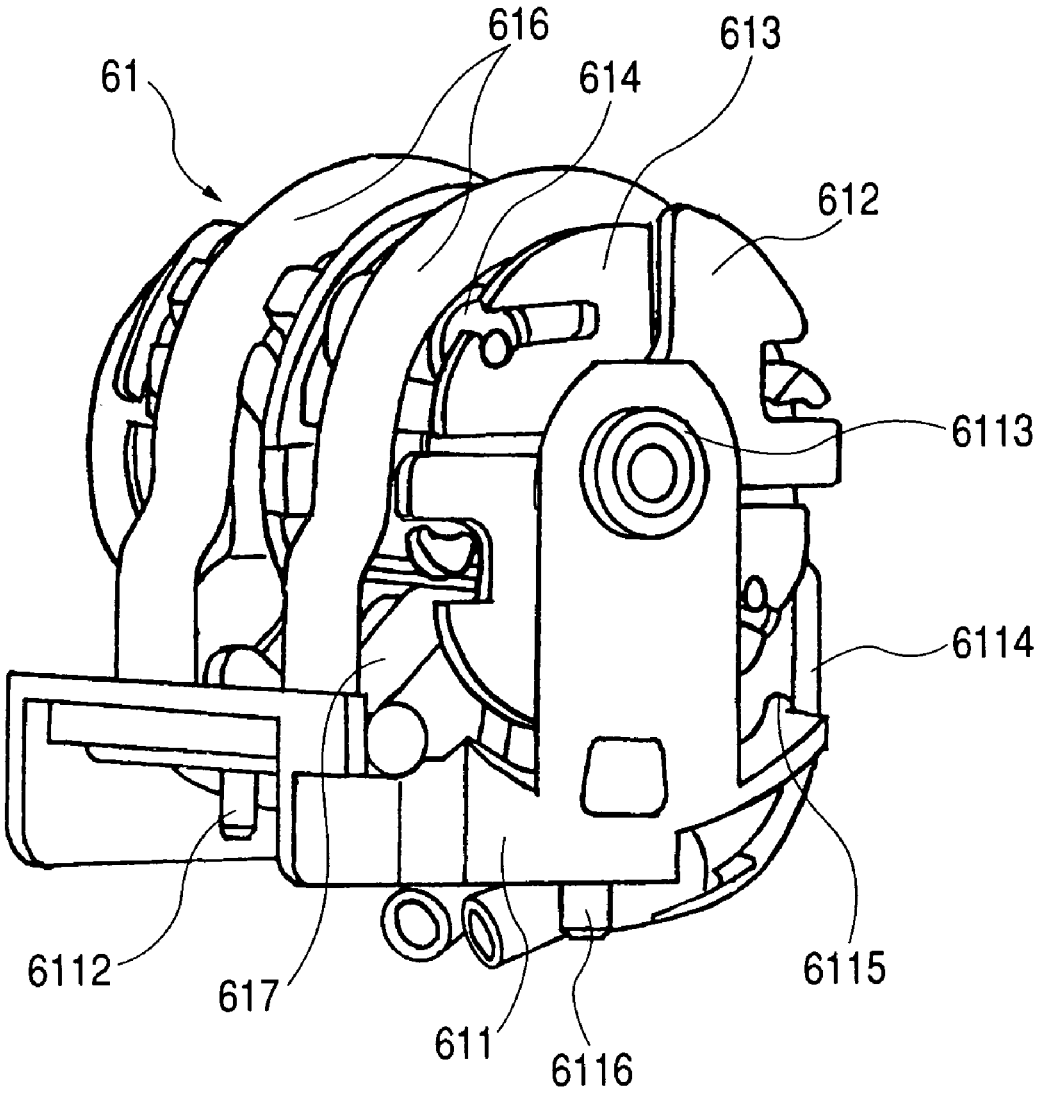
FIG. 7 is a typical perspective view showing the structure of a pump unit as suction means used in an embodiment of the discharge recovering apparatus of an ink jet recording apparatus to which the present invention is applied.
Figure 8:
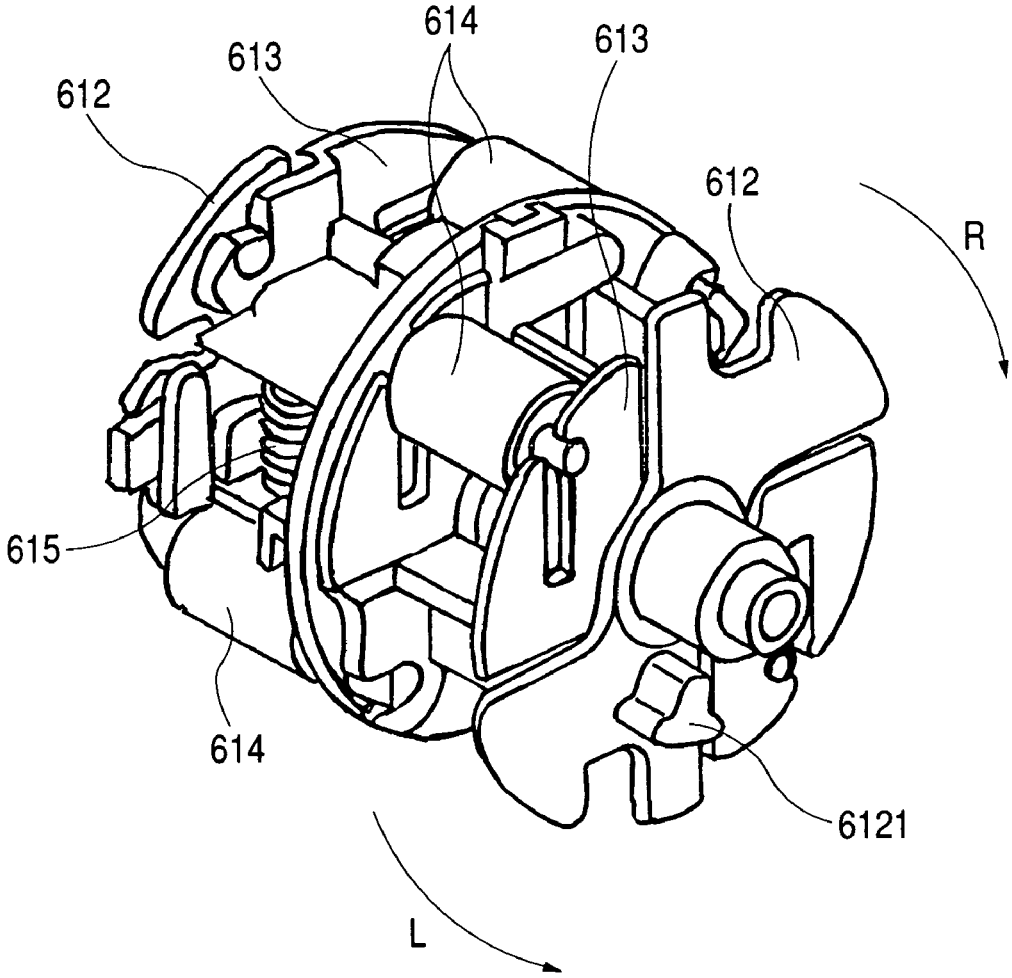
FIG. 8 is a typical perspective view showing the rotary member of the pump unit of FIG. 7.
Figure 9:
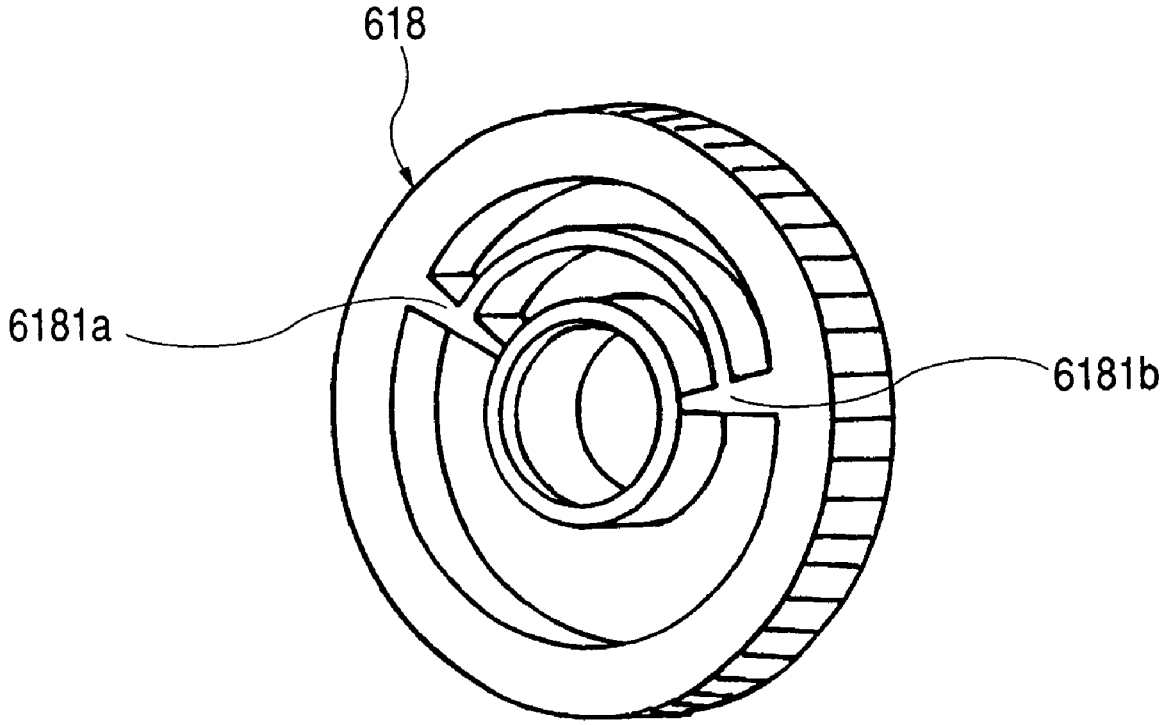
FIG. 9 is a typical perspective view showing a pump gear fitted to the rotary member of FIG. 8 for transmitting a rotative driving force.
Figure 10:
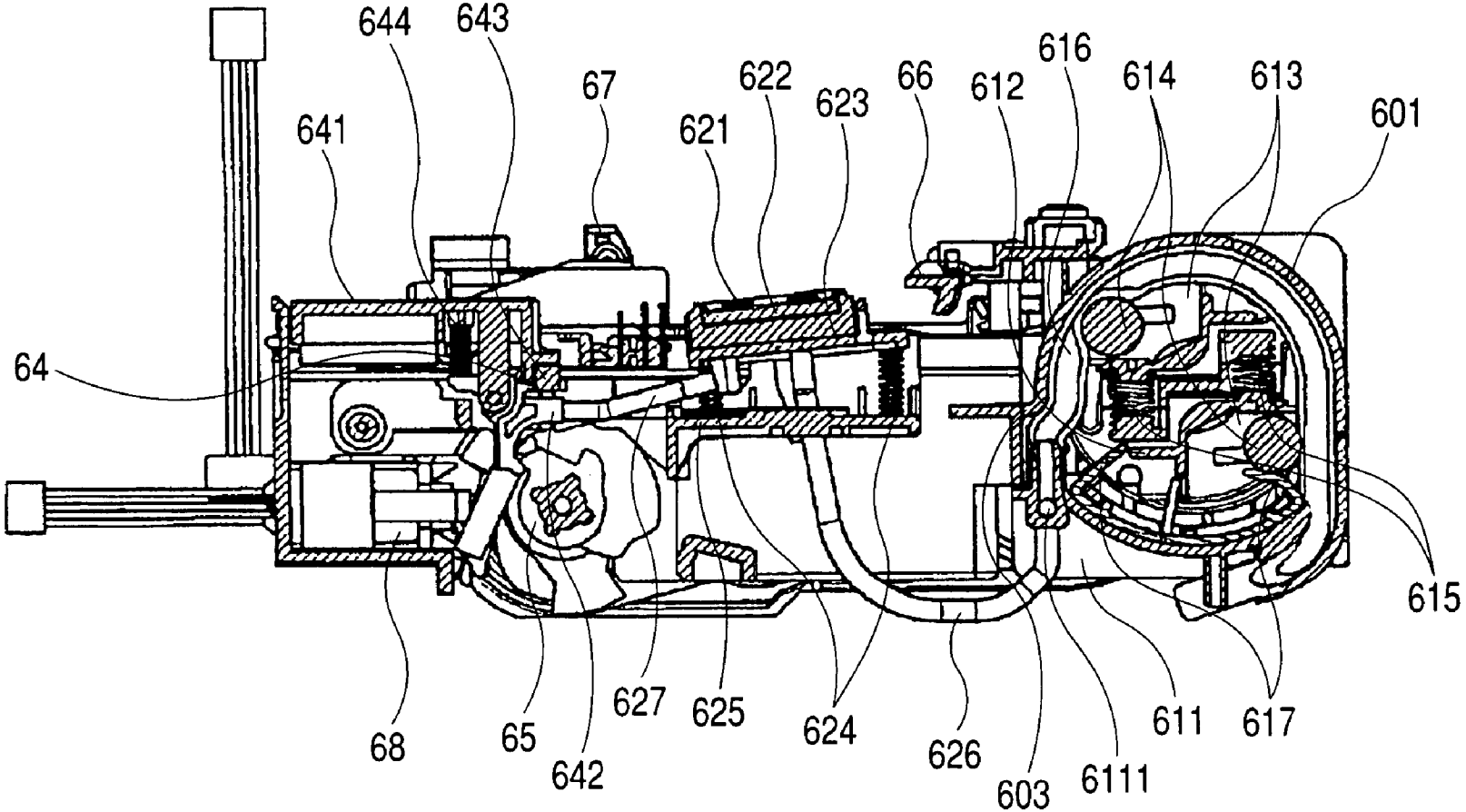
FIG. 10 is a typical vertical cross-sectional view showing the internal structure of an embodiment of the discharge recovering apparatus of an ink jet recording apparatus to which the present invention is applied.
Figure 11:
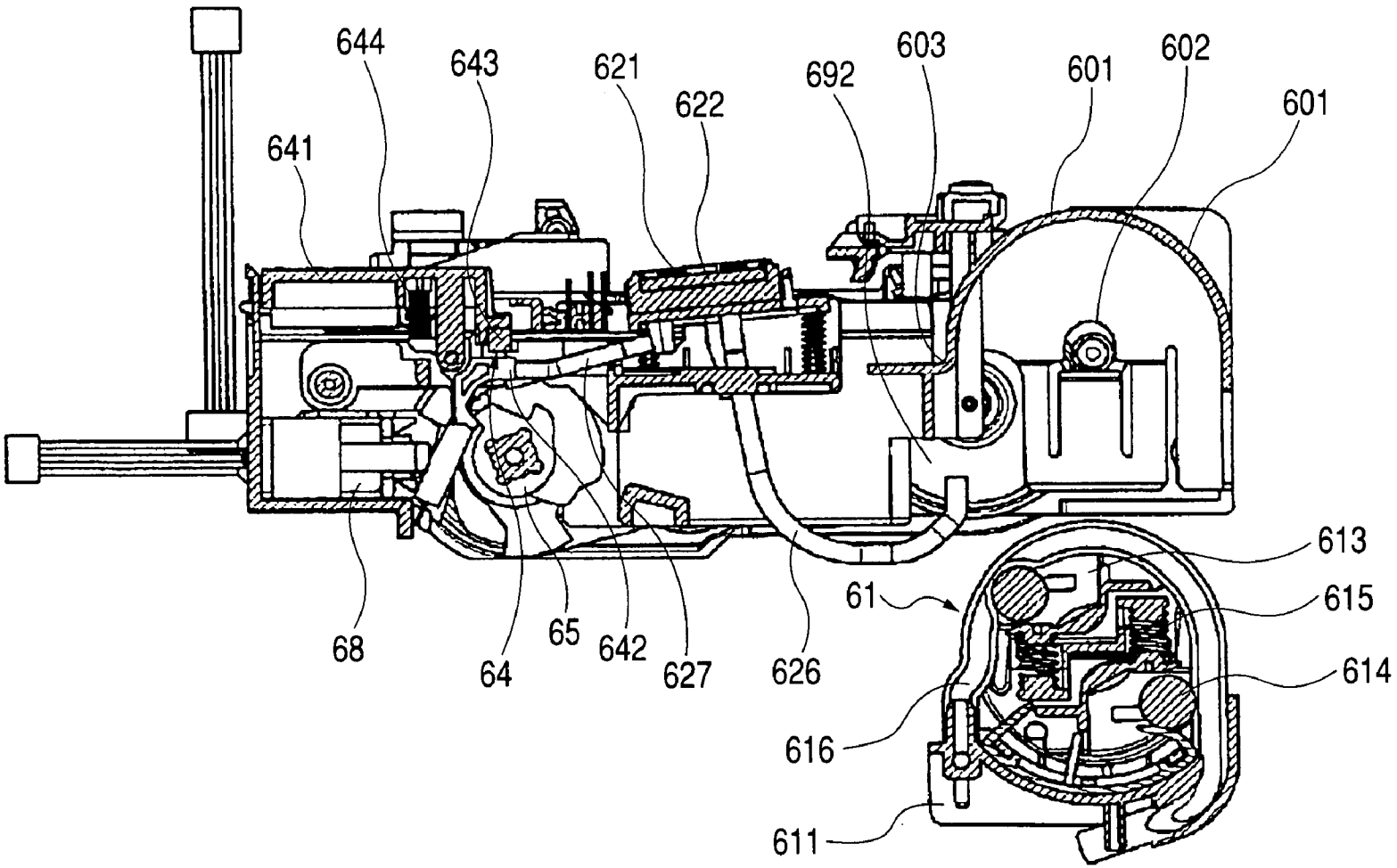
FIG. 11 is a typical vertical cross-sectional view showing a state in which a pump unit has been removed in the discharge recovering apparatus of FIG. 10.
Figure 12:
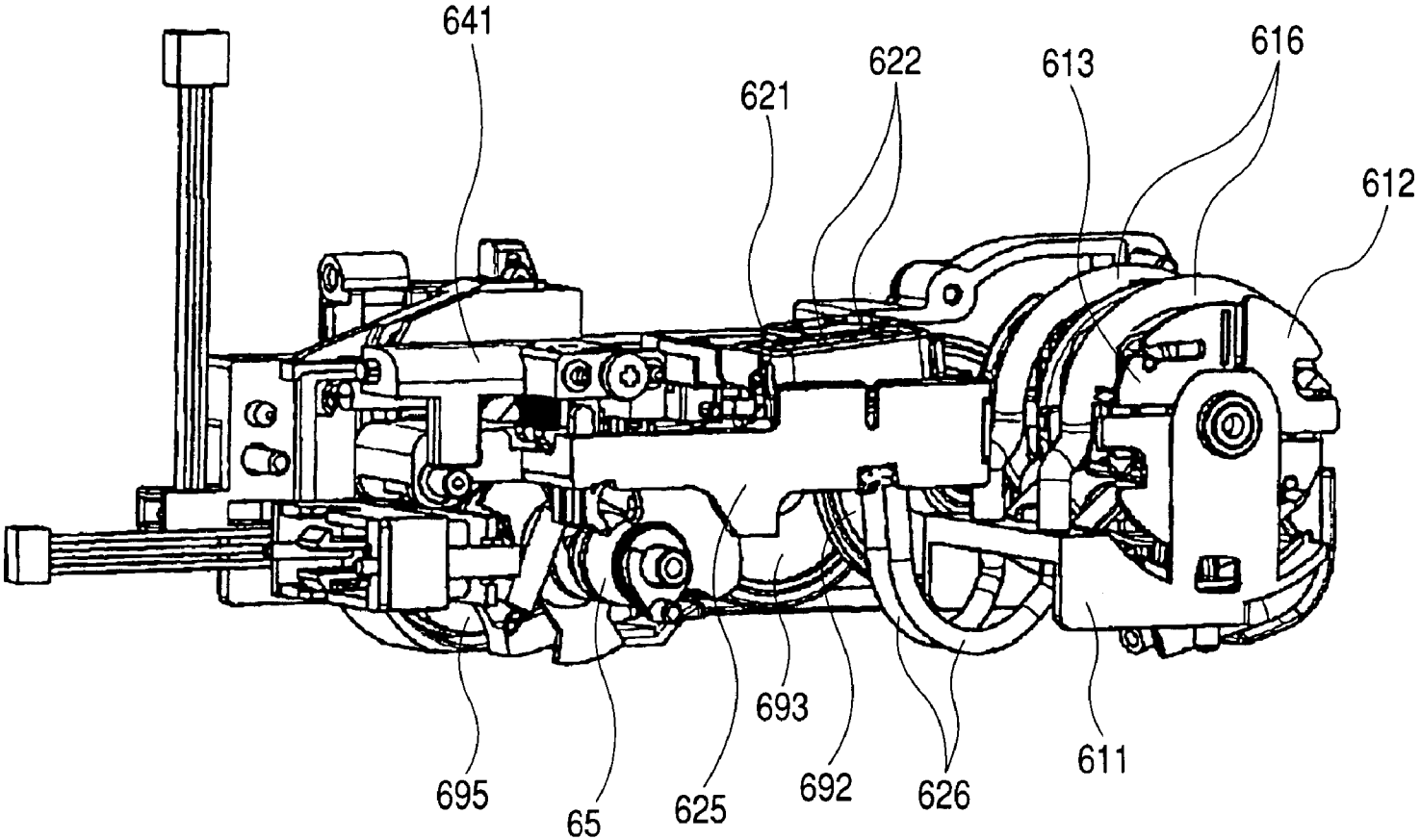
FIG. 12 is a typical perspective view showing the internal structure of another embodiment of the discharge recovering apparatus of an ink jet recording apparatus to which the present invention is applied.
Figure 13:
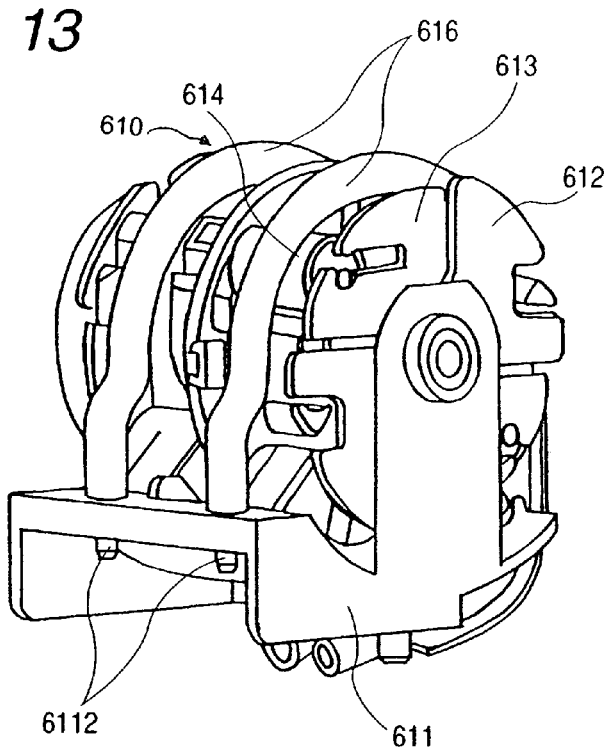
FIG. 13 is a typical perspective view showing the structure of a pump unit as suction means used in the discharge recovering apparatus of FIG. 12.
Figure 14:
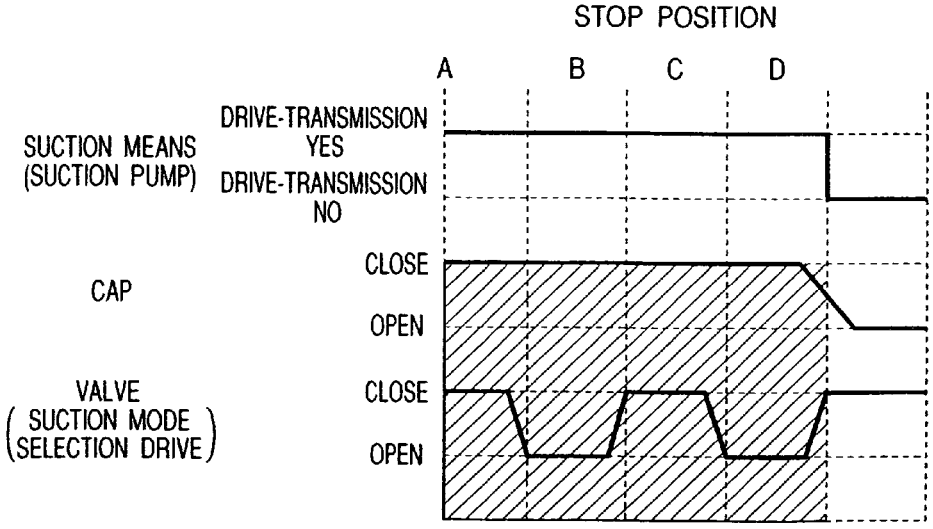
FIG. 14 is a cam chart showing the stop position of a cam for controlling the operation of the discharge recovering apparatus of an ink jet recording apparatus to which the present invention is applied.
Figure 15:
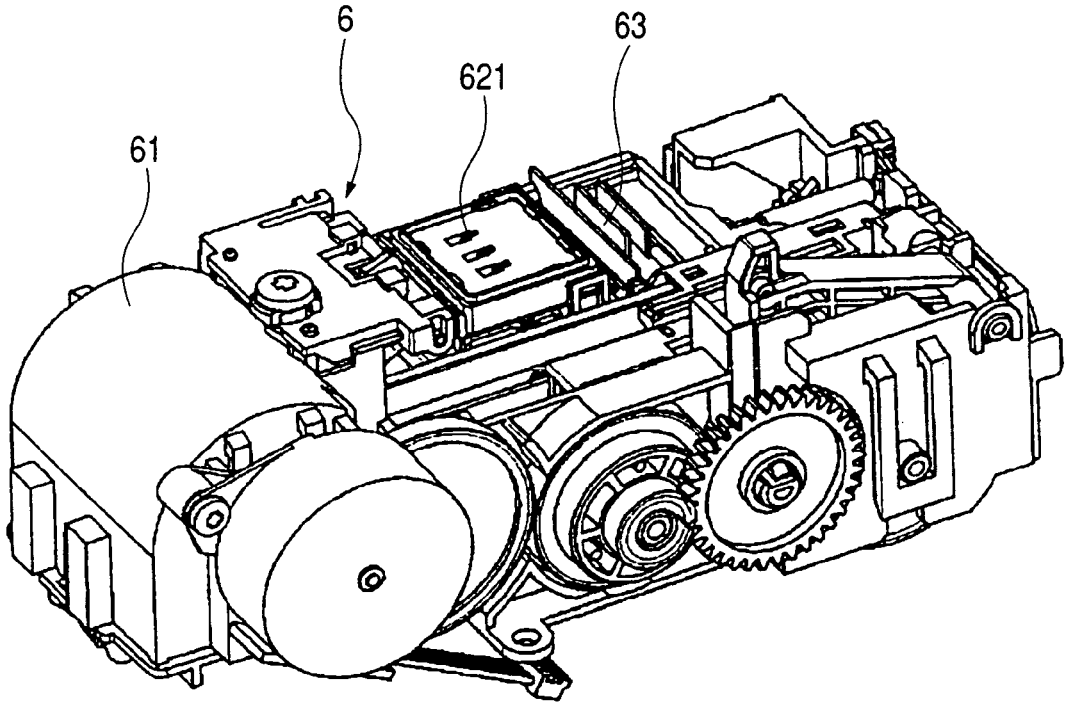
FIG. 15 is a typical perspective view showing an example of the construction of the discharge recovering apparatus of an ink jet recording apparatus according to the prior art.
Figure 16:
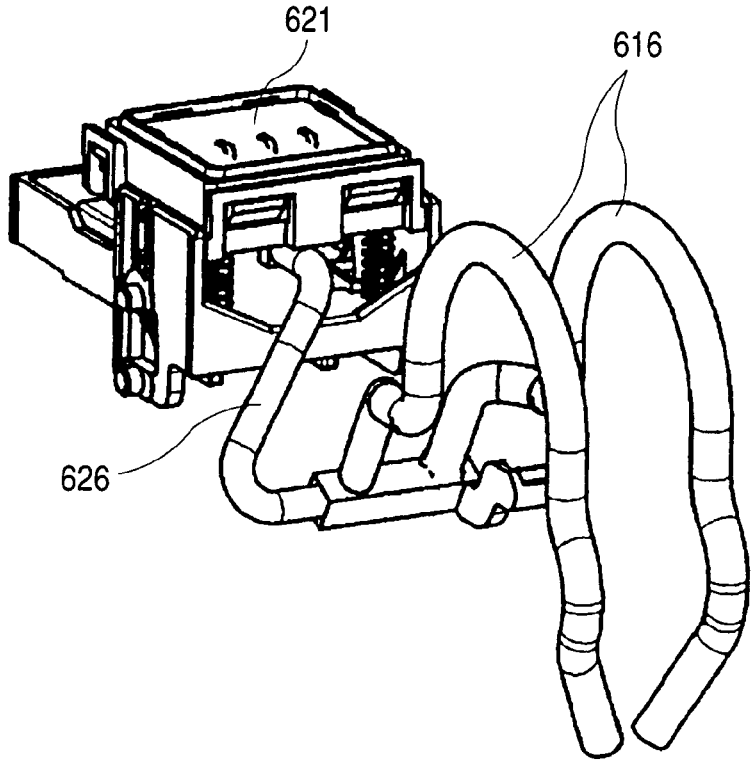
FIG. 16 is a typical perspective view showing the structure of the essential internal portions of the discharge recovering apparatus of the ink jet recording apparatus according to the prior art.
Figure 17:
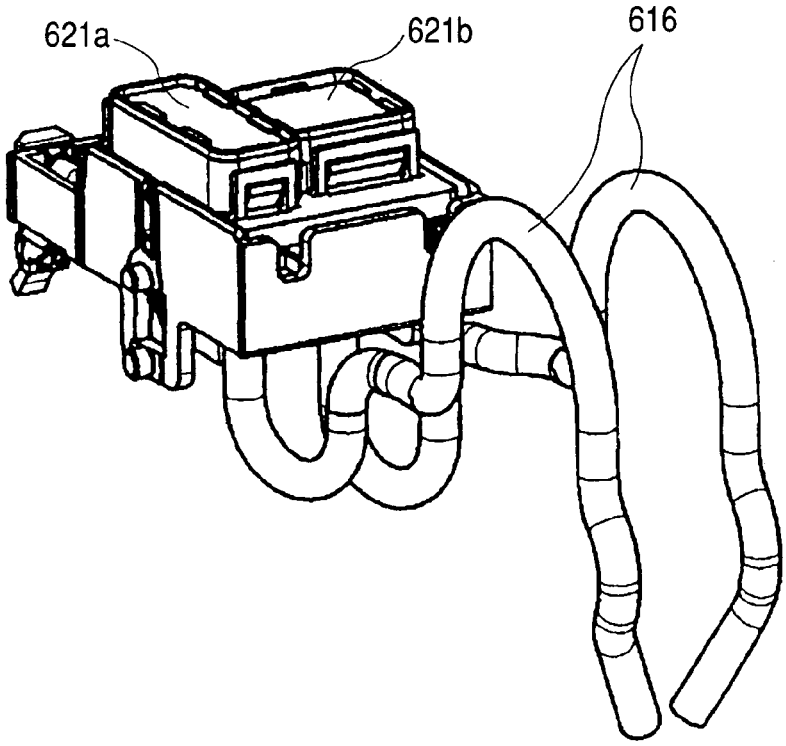
FIG. 17 is a typical perspective view showing another form of the structure of the essential internal portions of the discharge recovering apparatus of the ink jet recording apparatus according to the prior art.

The construction and operation of the discharge recovering apparatus 6 of the ink jet recording apparatus to which the present invention is applied will now be described with reference to FIGS. 4 to 15. FIG. 4 is a typical perspective view of an embodiment of the discharge recovering apparatus of the ink jet recording apparatus to which the present invention is applied as it is seen from the right front thereof, FIG. 5 is a typical perspective view of the discharge recovering apparatus of FIG. 4 as it is seen from the left side thereof, and FIG. 6 is a typical perspective view showing the interval structure of the discharge recovering apparatus of FIG. 5 with a recovering base as an external frame portion removed. FIG. 7 is a typical perspective view showing the structure of a pump unit as suction means used in an embodiment of the discharge recovering apparatus of an ink jet recording apparatus to which the present invention is applied, FIG. 8 is a typical perspective view showing the rotary member of the pump unit of FIG. 7, and FIG. 9 is a typical perspective view showing a pump gear fitted to the rotary member of FIG. 8 for transmitting a rotative driving force. FIG. 10 is a typical vertical cross-sectional view showing the internal structure of an embodiment of the discharge recovering apparatus of an ink jet recording apparatus to which the present invention is applied, and FIG. 11 is a typical vertical cross-sectional view showing a state in which a pump unit has been removed in the discharge recovering apparatus of FIG. 10. FIG. 12 is a typical perspective view showing the internal structure of another embodiment of the discharge recovering apparatus of the ink jet recording apparatus to which the present invention is applied, and FIG. 13 is a typical perspective view showing the structure of a pump unit as suction means used in the discharge recording apparatus of FIG. 12. FIG. 14 is a cam chart showing the stop position of a cam for controlling the operation of the discharge recovering apparatus of an ink jet recording apparatus to which the present invention is applied, and FIG. 15 is a flow chart illustrating the sequence of the suction recovering operation of the discharge recovering apparatus of an ink jet recording apparatus to which the present invention is applied.

The discharge recovering apparatus 6 according to the present invention is provided with the suction means 61, the capping means 62 and the wiping means 63 as recovering means for recovering and maintaining the ink discharging performance of the recording head 7. The suction means 61 is comprised of a tube pump (pump unit) having two (two lines of) pump tubes 616 disposed in parallel to each other, and a tube pump portion 610 is constituted by a (a line of) pump tube(s) 616. With an arcuate inner surface formed on a portion of the recovering base 60 as a guide surface 601, the two pump tubes 616 are disposed along the guide surface 601, and a pump unit (a tube pump and suction means) 61 comprising two lines of tube pump portions 610.

Each tube pump portion 610 is designed to generate negative pressure in each tube 616 by the tubes 616 disposed along the arcuate guide surface 601 being squeezed by pressing rollers (pump rollers) 614 rotatably journalled to a rotary member (a pump roller wheel 612, a pump roller holder 613) rotatably journalled to a tube guide 611 as a rotary member supporting member.

That is, a plurality of pressing rollers 614 for generating negative pressure in the tubes 616 are movably supported along the slot-shaped guide groove of the pump roller holder 613, and each pressing roller 614 is biased in a tube pressing direction by a roller spring (pump spring) 615. During the sucking operation of generating negative pressure in the pump tubes 616, the pressing rollers 614 are operated so as to crush (squeeze) the pump tubes 616 while being rolled and rotated (rotated and revolved), and during the time other than the sucking operation the pressing rollers 614 are adapted to be retracted from the pump tubes 616. Two pressing rollers 614 are disposed for each of the two pump tubes 616, and thus, four pressing rollers 614 in total are disposed.

In the present embodiment, the guide portion (guide surface) 601 of the recovering base 60 for guiding the pump tubes 616 are semicircular, and two pressing rollers (pump rollers) 614 are disposed for each pump tube 616 so as to have an angular phase of 180 degrees. By so constructing, even at a moment when one pressing roller 614 is released from a state in which it is pressing the pump tube 616, there can be brought about a state in which the other pressing roller 614 presses the pump tube 616, and by the two pressing rollers 614 being continuously rotated, it becomes possible to continuously perform the sucking operation while keeping the negative pressure in the pump tube 616. In a case where the shape of the guide portion 601 is substantially circular, a similar effect can also be realized even by a single pressing roller.

The pump roller holder 613 is journalled to the pump roller wheel 612 to permit pivotal movement in the radial direction of the arcuate guide surface 601 of the recovering base 60, and acts to press and retract the pressing rollers 614 against and from the pump tubes 616. The pump roller wheel 612 has the shaft portions of its opposite end portions journalled at the central position of the arc of the arcuate guide portion 601, whereby it is rotatably mounted by a driving force from a recovering motor 691 which is a driving motor being transmitted thereto. In the present embodiment, a rotary member for supporting the pressing rollers 614 is constituted by the pump roller wheel 612 and the pump roller holder 613, and this rotary member (the pump roller wheel 612, the pump roller holder 613) is rotatably journalled by the rotary member supporting member 611.

The transmission of a driving force from the recovering motor 691 to the suction means 61 is effected through a recovering gear 692 to a pump gear 618 disposed concentrically with the rotary shaft of the rotary member (in the present embodiment, the pump roller wheel 612). Design is made such that the rotative driving force of this pump gear 618 is transmitted when pump gear trigger bosses (protruding portion) 6121 disposed on one end surface of the pump roller wheel 612 abut against pump gear trigger ribs 6181*a* and 6181*b* by the rotation of the pump gear 618. That is, design is made such that the rotative driving force to the tube pump 61 is transmitted through a rotation transmitting mechanism having play (insensitive area) within a predetermined angle range.

The shape of the pump gear 618 will be described here with reference to FIG. 9. The pump gear 618 is provided with two ribs (gear trigger ribs 6181*a* and 6181*b*) therein, and is provided with a space on a side, and a boss coming into the space (the trigger boss 6121 of the roller wheel 612) and the two ribs 6181*a* and 6181*b* come into contact with each other, whereby a rotational force is transmitted to the roller wheel (rotary member) 612, whereby the pump unit (suction means) 61 comprising the tube pump is driven. Also, the suction means 61 is in the form of being directly connected to the rotative driving of the recovering motor 691, and is designed to perform a sucking operation by the one-direction rotation (hereinafter referred to as the forward rotation) of the recovering motor 691, and obtain the action of moving the pressing rollers 614 in a releasing direction from the pressed state against the pump tubes 616 by the reverse direction rotation (hereinafter referred to as the reverse rotation) of the recovering motor 691.

As one of the features of the discharge recovering apparatus 6 to which the present invention is applied, there is provided a bearing portion 6113 for journalling the pump roller wheel 612 to the tube guide 611 as a rotary member supporting member. In contrast, in the conventional discharge recovering apparatus, there has been provided a bearing portion for journalling a rotary member (pump roller wheel) to the recovering base itself. The recovering base is a part of which high rigidity and dimensional accuracy are required as a structure of the discharge recovering apparatus and therefore, a material having glass mixed therewith has been used for it, and the recovering base has been poor in slidability and the application of grease or the like thereto has been necessary. In the discharge recovering apparatus 6 according to the embodiment of the present invention, the tube guide 611 as the rotary member supporting member is made of a material such as POM excellent in slidability, whereby it is possible to construct a tube pump which can satisfy the performance as a bearing including a low sliding load and high durability during the sucking operation and at the same time, this bearing can be formed integrally with the tube guide 611 and accordingly, can omit the necessity of application of grease or the like without providing a special bearing part.

Also, the pump tubes (suction tubes) 616 are twined around the pump roller wheel 612 and one end portion of each of them is nipped by the guide portion (guide means) 6114 of the rotary member supporting member 611 and fixed by restraining portions (fixing means) 6115 and 6116. The other end portion of each of these pump tubes 616 is inserted in and fixed by joint portions 6111 integrally provided on the rotary member supporting member (tube guide) 611. The two joint portions 6111 are integrally connected to a joint portion 6112 by a tube path, and a joint tube 626 connected to the capping means 62 is connected to the joint portion 6112. The reason why there is not adopted a simple construction in which the two pump tubes 616 are directly connected to the capping means 62, but there is adopted a construction in which the two pump tubes 616 are integrated into a single joint tube 626 and connected to the capping means 62 is to prevent unevenness from occurring in the outflow state of the ink from each discharge port of the recording head 7 corresponding to each area in the cap and the flow state of the ink in the cap, due to a negative pressure difference caused by the part tolerance or the like between the two pump tubes 616.

As described above, a tube pump portion 610 is constituted by the rotary member supporting member (tube guide) 611, the pump roller wheel 612, the pump roller holder 613, the pressing rollers (pump rollers) 614, the pump spring 615, the pump tubes 616 and the pump roller damper 617. In the present embodiment, two sets of such tube pump portions are coupled together, whereby the suction means (the pump unit and the tube pump) 61 is constituted. Also, the pump roller wheel bearing portion 6113 of the rotary member supporting member 611 protrudes outwardly from the rotary member supporting member 611, and is restrained on the central fixing portion 602 of the guide portion 601 for bringing the pump tubes 616 into pressure contact by the cooperation of the recovering base 60 with the pressing rollers 614, whereby the pump unit 61 comprising two tube pump portions 610 is fixed to the recovering base 60, thus providing a construction completed as the suction means.

At this time, the upper part of the pressed-in portion of the pump tubes 616 to the joint portion 6111 of the rotary member supporting member 611 is held down by a pump tube presser 603 provided on the recovering base 60, whereby there is provided a construction in which the pump tubes 616 will not slip off even if a force which pulls the pump tubes 616 out of the joint portion 6111 acts. Also, by adopting the fixing means for the pump tubes 616 as described above, it is possible to make the incorporated state of the pump tubes 616 near the contact starting portions and escape portions of the pressing rollers 614 into a state suffering little from bending and crushing, whereby it is possible to prevent the occurrence of the fluctuation of a load during the rush-in of the pressing rollers 614, and prevent the earlier rotating phenomenon of the pressing rollers 614 relative to the rotary member (the phenomenon that the pressing rollers 614 are rotated earlier in the rotating direction than the rotation of the rotary member) due to the elastic restitutional repulsive force or the like of the pressing rollers 614 during the pump operation when the pump tubes are opened.

The hitherto described discharge recovering apparatus 6 is a discharge recovering apparatus in which all of ink tanks 71 carried on the recording head 7 use dye inks and which is suitable for increasing the number of discharge ports (making the discharge ports highly dense) and effecting the suction recovery of the recording head for recording images such as photographs at a high speed and a high quality of image, and can achieve improvements in the design efficiency (the shortening of the designing schedule and the curtailment of the personnel), and improvements in production efficiency (the curtailment of part manufacturing costs (such as mold costs), the curtailment of part custody costs, the shortening of the education period for assembly workers, etc.). To supply the ink jet recording apparatus 1 to consumers at a low price, it is desired that the discharge recovering apparatus 6 as previously described can be simply changed into a discharge recovering apparatus applicable to a recording head having a relatively small number of discharge ports, black pigment ink is discharged from a discharge port having a large discharge port diameter to thereby record monochromatic images such as black characters at a super-high speed and color dye inks are discharged from discharge ports having a small discharge port diameter to thereby record a color image such as a photographs at a high quality of image.

In the discharge recovery of such a recording head, however, it is desired to prevent such inconveniences as the adherence of the inks and the occurrence of the color mixing of the inks at the discharge ports of the dye inks, caused by the mixing of the black pigment ink and the color dye inks induced by being sucked in the same hermetically sealed chamber space of the cap. Further, the discharge port for the black ink and the discharge ports for the color inks differ greatly in the discharge port diameter from each other, and this is liable to cause the inconvenience that the ink flows out in a great deal from the discharge port having a large discharge port diameter and the inks do not flow out from the discharge ports having a small discharge port diameter. Therefore, as in a discharge recovering apparatus having another form of tube pump shown in FIG. 12, it is required that the pigment ink discharge port and the dye ink discharge ports be sucked through caps 621*a* and 621*b*, respectively, having individual hermetically sealed spaces corresponding thereto. That is, in the present embodiment, there is adopted a construction in which use is made of two joint tubes 626 connected to respective hermetically sealed spaces 621*a* and 621*b*, and the respective joint tubes 626 are individually connected to respective ones of the two pump tubes 616 of the pump unit 61.

Also, from the point that the number of discharge ports is small, it is necessary that the negative pressure generated by the suction means (tube pump) 61 which is required during ink suction be set to a small level, and it is required to use suction tubes (pump tubes) 616 having a small inner diameter. Another form of discharge recovering apparatus 6 shown in FIG. 12 is adapted to be constructed simply by changing only the rotary member supporting member (tube guide) 611 and the pump tubes 616 in the tube pump shown in FIGS. 10 and 11. Also, in the tube pump (suction means) 61 of the discharge recovering apparatus 6 of FIG. 12 used for the caps 621*a* and 621*b* having two hermetically sealed spaces, as shown in FIG. 13, the joint portion 6112 of the rotary member supporting member 611 is formed so as to have a small diameter correspondingly to the pump tubes 616 having a small inner diameter, and two such joint portions 6112 are provided, and two joint tubes 626 are individually connected to the two joint portions 6112. That is, from the two joint portions 6112, the pump tubes are connected to the two hermetically sealed spaces of the caps 621 by the two joint tubes 626.

In the tube pump 61 of FIG. 13, as compared with the tube pump of FIGS. 10 and 11, the inner diameter of the pump tubes 616 is changed to make the output performance of the pump greatly differ, but the thickness of the pump tubes 616 is made the same, whereby design is made such that even if with respect to pressing (pressure contact) and opening (releasing) the pump tubes 616 by the pressing rollers 614 and the guide portion 601 of the recovering base 60, the pump roller wheel 612, the pump roller holder 613, the pressing rollers 614, the pump spring 615, the pump roller damper 617 and the recovering base 60 remain common, a tube pump having a precise output characteristic can be realized easily.

According to the tube pump 61 as the suction means of the discharge recovering apparatus 6 according to the above-described embodiment, in a tube pump wherein the tubes 616 disposed along the arcuate guide portion 601 are squeezed by the rotary member 612 rotatably journalled to the rotary member supporting member 611 and the pressing rollers 614 rotatably journalled to the pump roller holder 613 pivotally supported on the rotary member 612 to thereby generate negative pressure in the tubes, there is adopted a construction in which the tubes 616, the pressing rollers 614, the rotary member 612, the pump roller holder 613 and the rotary member supporting member 611 are assembled to thereby form the pump unit 61, and are made separable from the guide portion 601 in the state of the pump unit. Therefore, there is obtained the effect that the incorporation of the pump tubes 616 becomes easy and the erroneous incorporation of the tubes in their buckled state or their twisted state can be eliminated easily.

Also, according to the above-described tube pump 61, in a tube pump wherein the pump tubes 616 disposed along the arcuate guide portion 601 are squeezed by the rotary member 612 rotatably journalled to the rotary member supporting member 611, and the pressing rollers 614 rotatably journalled to the pump roller holder 613 to thereby generate negative pressure in the tubes, there is adopted a construction in which the tubes 616, the pressing rollers 614, the rotary members 612, 613 and the rotary member supporting member 611 are assembled together to thereby form the pump unit 61, the relative distances between the pressing rollers 614 and the guide portion 601 are made common and also, tubes having different inner diameters are mounted as the tubes 616 to thereby enable tube pumps having different output characteristics to be made. Therefore, it is possible to make a tube pump which can commonly use all or almost all parts except the tubes 616 to precisely cope with a variety of ink jet recording means, and there is obtained the effect that improvements in design efficiency and production efficiency and the curtailment of costs can be achieved.

Further, according to the above-described tube pump 61, there is adopted a construction in which the rotary member supporting member 611 is removably mounted on the guide member (in the present embodiment, the recovering base 60) forming the guide portion 601, and the guide member is made of a material of high rigidity and also, the rotary member supporting member is made of a material excellent in slidability, that is, a construction in which at least one of the guide member and the rotary member supporting member 611 is made of a material having slidability. Therefore, there is obtained the effect that without adding a bearing, the guide member and the rotary member 612 can avoid directly sliding, and without the occurrence of part costs, any increase in the load of the sliding region of the rotary member supporting member, the occurrence of the abrasion thereof and the production of abnormal sound can be prevented to thereby eliminate the necessity of applying grease.

Also, in the above-described embodiment, design is made such that a pump gear 618 for transmitting rotational force to the rotary member 612 and the pump roller holder 613 is mounted in the pump unit 61, and that the rotary member is formed by the roller holder 613 for holding the pressing rollers 614 to permit movement in the radial direction thereof and the roller wheel 612 for holding this roller holder.

Also, in the above-described embodiment, there are adopted a construction in which fixing means 6111 and 6112 for fixing the tubes 616 are provided in the pump unit 61, a construction in which at least one of the fixing means for fixing the tubes 616 is formed integrally with the rotary member supporting member 611, a construction in which the joint portions 6111 and 6112 for connecting the tubes 616 to an external flow path are provided in the pump unit 61, a construction in which the rotary member supporting member 611 and the joint portions 6111 and 6112 are formed by a single part, and further, a construction in which at least one of the fixing means is the joint portion, whereby there is obtained the effect that the creeping of the tubes 616 can be completed at the pump portion to thereby improve the incorporability thereof. The rotary member supporting member 611 and the fixing means or the joint portions 6111 and 6112 are formed by a single part, whereby any extra joint part and the assembling step therefor can be eliminated.

Also, in the aforedescribed embodiment, the pressing rollers 614 are held to permit movement in the radial direction relative to the pump roller holder 613 of the rotary member, and are designed to be moved radially outwardly by the rotation of the rotary member in one direction to cause a tube pressing state, and to be moved radially inwardly by the rotation of the rotary member in a reverse direction to release the tube pressing state. Further, a biasing member (pressing roller spring) 615 for biasing the pressing rollers in a direction opposite to the direction of movement by the rotary member upon contact with the pressing rollers is provided on the movement path of the pressing rollers 614, and this biasing member is designed to be retractable during the passage of the pressing rollers. According to such a construction, it is possible to mitigate the fluctuation of a load during the rush-in of the pressing rollers 614, or prevent the occurrence of the earlier rotating phenomenon of the pressing rollers 614 relative to the rotary member (driving means) (the phenomenon that the pressing rollers 614 are rotated earlier in the direction of rotation than the rotation of the rotary member) by the elastic restitutional repulsive force or the like of the pressing rollers 614 during the pump operation when the pump tube is opened.

Furthermore, in the aforedescribed embodiment there are adopted a construction in which when the relative distances between the pressing roller 614 and the guide portion 601 are made common to each other and also tubes having different inner diameters are mounted as the pump tubes 616, so that it is made possible to make a plurality of kinds of tube pumps having different output characteristics, the guide portions 601 of the plurality of kinds of tube pumps are formed by common parts, a construction in which the biasing forces of the biasing means (pressing roller springs) 615 for biasing the pressing rollers 614 toward the pump tubes 616 are made the same, a construction in which the rotary member 612 and parts to be assembled to the rotary member are common parts, a construction in which the tube pumps having the different output characteristics differ only in the inner diameter of the tubes 616 and the other parts are common parts, and further, a construction in which the thicknesses of the pump-tubes having the different inner diameters are made the same.

In FIGS. 4 to 13, the capping means 62 is comprised of a cap 621 (including caps 621*a* and 621*b* for forming individual hermetically sealed spaces) contacting with the discharge port surface (the ink discharge surface formed with discharge ports) of the recording head 7, a cap absorbing member 622 for efficiently sucking the ink discharged from the discharge port surface of the recording head 7, a cap holder 623 for supporting the cap 621, and bringing the cap 621 into pressure contact with the discharge port surface 621 of the recording head 7 by a cap spring 624, the cap spring 624 for giving cap pressure (the closely contacting force of the cap) to the cap holder 623, a cap base 625 which is a lift lever for supporting the cap spring 624 and supporting the cap holder 623 for sliding movement in a vertical direction, and bringing the cap 621 into contact with and away from the discharge port surface of the recording head 7, a joint tube for connecting the interior of the cap 621 and the tube pump 61 together, and a valve tube 627 for connecting the interior of the cap 621 and an openable and closable valve 64 for opening to atmosphere together.

The valve 64 is comprised of a valve lever 642, valve rubber 643 and a valve lever spring 644, which are assembled to a valve base 641. The valve lever 642 is rotatably journalled to the valve base 641. A tube path is formed in the interior of the valve lever 642, and one end portion thereof is a joint portion for connecting it to the valve tube 627, and the other end portion thereof is an openable and closable valve portion adapted to be brought into contact with and away from the valve rubber 643 by the rotation of the valve lever 642 to thereby change over the opened and closed states of the tube path of the valve 64.

The valve lever spring 644 biases the valve lever 642 in a direction to abut against the valve rubber 643. By the valve 64 being opened and closed, the interior of the cap 621 connected thereto by the valve tube 627 can be changed over so as to be opened and hermetically sealed relative to the atmosphere.

In the present embodiment, a cap absorbing member 622 is provided in the cap 621. The upward and downward movement for bringing the capping means 62 into contact with the recording head 7 and the opening and closing operation of the valve 64 are effected by the drive from the recovering motor 691 (FIG. 4) being transmitted via recovering gears 693, 694, etc. and through a one-way clutch gear 695. This one-way clutch gear 695 is fitted to a cam 65 for executing the upward and downward movement of the capping means 62 and the opening and closing operation of the valve 64, and is designed to transmit the driving force from the recovering motor 691 to the cam 65 during one-direction rotation, and to be idly rotated during the other-direction rotation so as not to transmit the drive to the cam 65.

The cam 65 is designed to control the operation of the aforedescribed capping means 62, and in addition, control the driving of the wiping means 63 and control the upward and downward movement of a CR lock lever 67 for effecting the positioning of the recording head 7 and the capping means of the discharge recovering apparatus 6 during the recovering operation of the recording head 7. The operation of each of the aforedescribed means is executed by effecting the rotational positioning of the cam 65 by a flag for a cam position detecting sensor provided on the cam 65 and the cam position detecting sensor 68, and controlling each means on the basis thereof.

Description will now be made of a suction recovering mode for the discharge recovering operation in the ink jet recording apparatus, in which by the driving of the recovering motor 691 in one direction, the suction means (tube pump) 61 for effecting suction recovery is driven and by the driving of the recovering motor in a reverse direction, both of the capping means 62 for bringing the cap 621 into contact with and away from the discharge port surface of the recording head 7 and the wiping means 63 for wiping the discharge port surface of the recording head 7 are drive-controlled by the cam 65 having a position detecting flag portion coaxially therewith and the cam position detecting means (sensor) 68. The suction recovering operation of the recording head 7 by the discharge recovering apparatus 6 in the ink jet recording apparatus according to the present embodiment is executed by such an operation sequence as shown in the flow chart of FIG. 14. The flow chart of FIG. 14 shows the general suction recovering operation of the discharge recovering apparatus 6 in the present embodiment.

The details of the suction recovering mode in the present embodiment will hereinafter be described with reference to FIG. 14 which is a cam chart showing the stop position of the cam 65 for controlling the operation of the discharge recovering apparatus 6. In FIG. 14, the states of the discharge recovering apparatus in cam positions A to D are as follows:

A: Recovering system HP (valve is closed)

B: Initialization of the pressing rollers (valve is opened)

C: Suction (valve is closed)

D: Idle suction (valve is opened)

Also, an area indicated by hatching in FIG. 14 is an area in which there is no drive transmission to the suction means side (suction mode selecting side cam driving range). When a suction recovering operation command is given, the position of the cam 65 constituting the discharge recovering apparatus 6 is detected by the cam position detecting sensor 68, and the positions of the capping means 62 and the wiping means 63 are confirmed. When the recording head 7 is not in a suction recovering operation position, the recovering motor 691 is reversely rotated till the termination of the return movement of the wiper. Then, it is confirmed by the cam position detecting sensor 68 that the capping means 62, the wiping means 63, etc. are in a state in which they do not interfere with the recording head 7, whereafter the carriage motor 54 is driven to thereby move the recording head 7 to the suction recovering operation position.

Thereafter, the cam 65 is rotatively driven by the recovering motor 691 to thereby bring the capping means 62 into contact with the discharge port surface of the recording head 7. The direction of rotation of the pump roller wheel 612 in that case is a direction of rotation R indicated in FIG. 8 and therefore, the pressing rollers 614 of the suction means 61 are disposed at locations spaced apart from the pump tubes 616 to thereby communicate the interior of the cap with the atmosphere. That is, by the interior of the cap being communicated with the atmosphere, even if the pump roller wheel 612 is rotated, the inks residual in the pump tubes 616 will not flow back into the cap 621 and it will never happen that positive pressure is applied to the interior of the cap to thereby damage the discharge ports of the recording head 7. After the cap 621 is brought into contact with the discharge port surface of the recording head 7, the recovering motor 691 is forwardly rotated to thereby rotatively drive the pump roller holder 612 in a direction of rotation L in FIG. 8.

At that time, the capping means 62 is in contact with the discharge port surface of the recording head 7 and therefore, by the rotation of the cam 65, the valve 64 is brought into its opened state, whereby any extra negative pressure is prevented from being applied to the interior of the cap when the pump roller wheel 612 is rotated in the direction of rotation R. So, by the forward rotation of the recovering motor 691, the pump gear trigger bosses 6121 of the pump roller wheel 612 and the pump gear trigger ribs 6181*a* and 6181*b* of the pump gear 618 are brought into contact with each other and the pump roller wheel 612 is rotated in the direction of arrow L to thereby bring about a state in which the pressing rollers 614 press the pump tubes 616 (the crushed state of the tubes).

This operation is for suppressing the unevenness of the amount of crush, i.e., the amount of ink suction, of the pump tubes 616 in an insensitive area until the pressing rollers 614 press the pump tubes 616 by selecting the pressing rollers 614 in a position wherein they are pressed against the pump tubes 616. By effecting such selection of the initial position of the pressing rollers 614, even if a pump roller sensor which has been necessary for the detection of the position of the pressing rollers 614 is absent, the unevenness of the amount of ink suction can be made little, whereby it becomes possible to perform a stable suction recovering operation.

After such pressing rollers 614 are pressed against the pump tubes 616, the tube pump 61 is forwardly rotated to thereby perform the ink sucking operation from the recording head 7. This sucking operation is executed by closing the valve 64 of the capping means 62 to thereby render the interior of the cap 621 hermetically sealed, and giving negative pressure to the interior of the cap by the suction rotating operation of the tube pump (suction means) 61 to thereby discharge the inks from the recording head 7. By opening and closing the valve 64 by the rotation of the cam 65, it is possible to control the hermetically sealing and opening of the interior of the cap.

The aforedescribed operation of the valve 64 is also performed with the recovering motor 691 as a drive source and therefore, the closing operation of the valve 64 must be accomplished without the pressing state of the pressing rollers 614 being broken. So, design is made such that as long as the cap 621 is in contact with the recording head 7, when the cam 65 is to be rotated by the driving of the recovering motor 691 through a one-way clutch gear (not shown) to thereby operate the valve 64, the pump gear trigger ribs 6181*a* and 6181*b* of the pump gear 618 do not abut against the pump gear trigger bosses 6121 provided on the end surface of the pump roller wheel 612 of the suction means 61 to transmit the driving force of the recovering motor 691 to the suction means 61 side. That is, design is made such that the drive transmission to the suction means 61 is released during the opening and closing operation of the valve 64 (the hatched area of FIG. 14) in a state in which the drive is transmitted to the cam 65 side by the recovering motor 691.

Consequently, the interval between the pump gear trigger ribs 6181*a* and 6181*b* of the pump gear 618 is set to such an interval that in the hatched area shown in FIG. 14, the driving force of the recovering motor 691 is not transmitted to the suction means 61 side, taking into account the angle of rotation of the cam 65 in the opening and closing operation area of the valve 64, the reduction ratio of the gear of a drive transmitting portion leading from the recovering motor 691 to the tube pump 61, and the reduction ratio of the gear for transmitting the driving force to the cam 65. In order to discharge wasted inks (sucked inks) stored in the cap 621 from the interior of the cap 621 after the suction recovering operation, the valve 64 is rendered opened by the rotation of the cam 65.

If during this opening operation of the valve 64, the drive is transmitted to the suction means 61, the inks will be caused to flow back from the tube pump 61 into the cap 621 by the drawing of the pump tubes 616 by the pressing roller 614, thus giving damage to the recording head 7, because the driving direction is a reversely rotating direction. In the present embodiment, however, design is made such that even during the aforedescribed operation, the pump gear trigger ribs 6181*a* and 6181*b* of the pump gear 618 are rotatively driven away from the pump gear trigger bosses 6121 on the pump roller wheel 612. Therefore, it never happens that the tube pump 61 is rotatively driven, and that any inconvenience is caused by the back flow of the inks.

After the valve 64 is rendered opened, the tube pump 61 is driven in a direction to perform the suction recovering operation (a forwardly rotating direction) by the recovering motor 691, and at that time, an idle sucking operation for discharging the residual inks in the cap out of the discharge recovering apparatus is executed. After this idle sucking operation is terminated, the pressing rollers 614 are brought into a state in which the tube pressing thereof has been released (tube opening state). Thus, the general suction recovering operation is terminated.

In a discharge recovering apparatus 6 according to a modification of the embodiment shown in FIGS. 12 and 13, design may be made such that the rotary member supporting member (tube guide) 611 is partly changed and the inner diameters of the mounted two pump tubes 616 are made different from each other, to thereby provide a great difference in the negative pressure acting on the two hermetically sealed spaces of the cap 621. Whereby, the suction of the recording head 7 is effected with a proper suction force necessary for the drawing-out of the inks from the discharge ports so as to be capable of coping with a recording head portion using a discharge port having a large discharge port diameter as for the black pigment ink and a recording head portion using discharge ports having a small discharge port diameter as for the dye inks. Also, design may be made such that the number of pump tubes in the discharge recovering apparatus 6 according to the modification of FIGS. 12 and 13 is decreased from two to one to thereby cause small negative pressure to act on a hermetically sealed space and cope with a head 7 capable of sucking.

While in the above-described embodiments, description has been made with the case of a discharge recovering apparatus having two pump tubes 616 mounted thereon taken as an example, the present invention can be likewise applied to a discharge recovering apparatus having one or three or more pump tubes mounted thereon, and achieves a similar operational effect, and these are also covered within the scope of the present invention. Also, while in the above-described embodiments, description has been made with an ink jet recording apparatus of the serial recording type in which recording is effected while the recording means 7 is moved relative to a recording material taken as an example, the present invention can be likewise applied to an ink jet recording apparatus of the line recording type which effects recording by sub-scanning alone by the use of recording means of the line type having a length covering the whole or part of the width of a recording material, and can achieve a similar effect. Also, the present invention can be likewise applied to a recording apparatus using a single recording means, a color recording apparatus using a plurality of recording means for recording with inks of different colors, or a gradation recording apparatus using a plurality of recording means for recording in the same color and at different density, and further, a recording apparatus comprising a combination of these, and can achieve a similar effect.

Further, the present invention can be likewise applied to any arrangement and construction of a recording head and an ink tank, such as a construction in which use is made of an interchangeable cartridge comprising a recording head and an ink tank made integral with each other, or a construction in which a recording head and an ink tank are made discrete from each other and are connected together by an ink supplying tube or the like, and can obtain a similar effect. The present invention can also be applied to a case where an ink jet recording apparatus uses, for example, recording means using an electro-mechanical converting member such as a piezoelectric element, and above all, brings about an excellent effect in an ink jet recording apparatus using recording means of a type discharging ink by the utilization of heat energy. It is because according to such a type, the higher density and higher definition of recording can be achieved.

What is claimed is:

1. A discharge recovering apparatus for recovering and maintaining the ink discharging performance of recording means for discharging ink, comprising:

a cap for covering the recording means;

a tube connected to said cap;

a pressing roller for squeezing said tube;

a rotary member to which said pressing roller is rotatably journalled;

a supporting member to which said rotary member is rotatably journalled; and a fixing member for fixing said tube, wherein said tube, said pressing roller, said rotary member, said supporting member and said fixing member are assembled to thereby form a pump unit, and are separable from an arcuate guide portion in the form of said pump unit.

2. An ink jet recording apparatus for discharging ink from recording means to a recording material to thereby effect recording, comprising:

a cap for covering the recording means;

a tube connected to said cap;

a pressing roller for squeezing said tube, a rotary member to which said pressing roller is rotatably journalled;

a supporting member to which said rotary member is rotatably journalled; and a fixing member for fixing said tube, wherein said tube, said pressing roller, said rotary member, said supporting member and said fixing member are assembled to thereby form a pump unit, and are separable from an arcuate guide portion in the form of said pump unit.

3. An ink jet recording apparatus according to claim 2, wherein said supporting member is removably mounted on a guide member forming the guide portion, and at least one of the guide member and said supporting member is formed of a material having slidability.

4. An ink jet recording apparatus according to claim 2, wherein said pump unit comprises a pump gear for transmitting a rotational force to said rotary member.

5. An ink jet recording apparatus according to claim 2, wherein said fixing member is formed integrally with said supporting member.

6. An ink jet recording apparatus according to claim 2, wherein said pump unit comprises a joint portion for connecting said tube to an external route.

7. An ink jet recording apparatus according to claim 6, wherein said joint portion is formed integrally with said supporting member.

8. An ink jet recording apparatus according to claim 2, wherein said pressing roller is held to permit movement in a radial direction thereof relative to said rotary member, said pressing roller is radially outwardly moved by the rotation of said rotary member in one direction to thereby assume a tube pressing state, and said pressing roller is radially inwardly moved by the rotation of said rotary member in the other direction to thereby release the tube pressing state.

9. An ink jet recording apparatus according to claim 8, further comprising a biasing member, wherein on a movement route of said pressing roller, said biasing member biases, upon contact with said pressing roller, said pressing roller in a direction opposite to a movement direction by said rotary member, and said biasing member is retractable during a passage of said pressing roller.

10. An ink jet recording apparatus according to claim 2, wherein relative distances between said pressing roller and the guide portion are made common and a tube differing in inner diameter is mounted to thereby form a tube pump differing in output characteristics.

11. An ink jet recording apparatus according to claim 10, wherein the guide member of said tube pump differing in output characteristics is formed of a common part.

12. An ink jet recording apparatus according to claim 10, further comprising a biasing member for biasing said pressing roller toward said tube, and wherein a biasing force of said biasing member in the tube pump differing in output characteristics is made the same.

13. An ink jet recording apparatus according to claim 10, wherein in the tube pump differing in output characteristics, all of said rotary member and parts incorporated in said rotary member are made common.

14. An ink jet recording apparatus according to claim 13, wherein the tube pump differing in output characteristics differs only in the inner diameter of said tube and is common in the other parts.

15. An ink jet recording apparatus according to claim 10, wherein the tube differing in inner diameter has a same thickness.

* * * * *

UNITED STATES PATENT AND TRADEMARK OFFICE

CERTIFICATE OF CORRECTION

PATENT NO. : 7,011,387 B2
APPLICATION NO. : 10/633530
DATED : March 14, 2006
INVENTOR(S) : Hiroyuki Saito et al.

It is certified that error appears in the above-identified patent and that said Letters Patent is hereby corrected as shown below:

COLUMN 3
Line 30, “a-mixture” should read --a mixture--.

COLUMN 10
Line 23, “interval” should read --internal--.

COLUMN 16
Line 35, “pump-tubes” should read --pump tubes--.

COLUMN 21
Line 11, “tube,” should read --tube;--.

Signed and Sealed this

Twenty-fourth Day of July, 2007

JON W. DUDAS
*Director of the United States Patent and Trademark Office*